US005623865A

United States Patent [19]

Sidiropoulos

[11] Patent Number: 5,623,865

[45] Date of Patent: Apr. 29, 1997

[54] INFUSER

[76] Inventor: Perry Sidiropoulos, 15 Woodville Rd., Granville 2142 NSW, Australia

[21] Appl. No.: 652,526

[22] PCT Filed: Dec. 2, 1994

[86] PCT No.: PCT/AU94/00750

§ 371 Date: Jun. 3, 1996

§ 102(e) Date: Jun. 3, 1996

[87] PCT Pub. No.: WO95/15105

PCT Pub. Date: Jun. 8, 1995

[30] Foreign Application Priority Data

Dec. 3, 1993 [AU] Australia ..... PM2771
Apr. 8, 1994 [AU] Australia ..... PM5140

[51] Int. Cl.[6] ..... A47J 31/00

[52] U.S. Cl. ..... 99/323; 426/77

[58] Field of Search ..... 99/323, 279, 287, 99/295, 316, 317, 318, 321; 426/77, 433

[56] References Cited

U.S. PATENT DOCUMENTS

| | | | |
|---|---|---|---|
| 1,313,582 | 8/1919 | Cowan | 99/323 |
| 3,102,465 | 9/1963 | Montesano | 99/323 |
| 3,946,652 | 3/1976 | Gorin | 99/323 |
| 4,215,628 | 8/1980 | Dodd | 426/77 |
| 4,338,338 | 7/1982 | Popkes | 99/323 |
| 4,821,630 | 4/1989 | Roberts | 426/77 |
| 4,986,451 | 1/1991 | Lowe | 426/77 |

*Primary Examiner*—Robert W. Jenkins
*Attorney, Agent, or Firm*—Townsend and Townsend and Crew LLP

[57] ABSTRACT

An infuser (1) comprising an elongated member (2) having at one end (4), a gripping portion (64) and, at the other end (3), a perforated or porous wall portion (5) forming the infuser charge holding chamber. A sleeve (9) slides along the elongated member (2) to cover or expose the perforations (8) or the porous material (40). To use the infuser (1), the infuser (1) is gripped by the gripping portion (64) and the sleeve (9) slid towards the gripping end (64), exposing the hygienically covered perforations (8) or porous material (40), which is stirred into boiling water to extract the required flavour or substances from the infuser charge. Upon completion the infuser is removed above the water and the sleeve (9) is slid down sealing the perforations (8) or porous material to lessen leakage from the infuser (1).

15 Claims, 23 Drawing Sheets

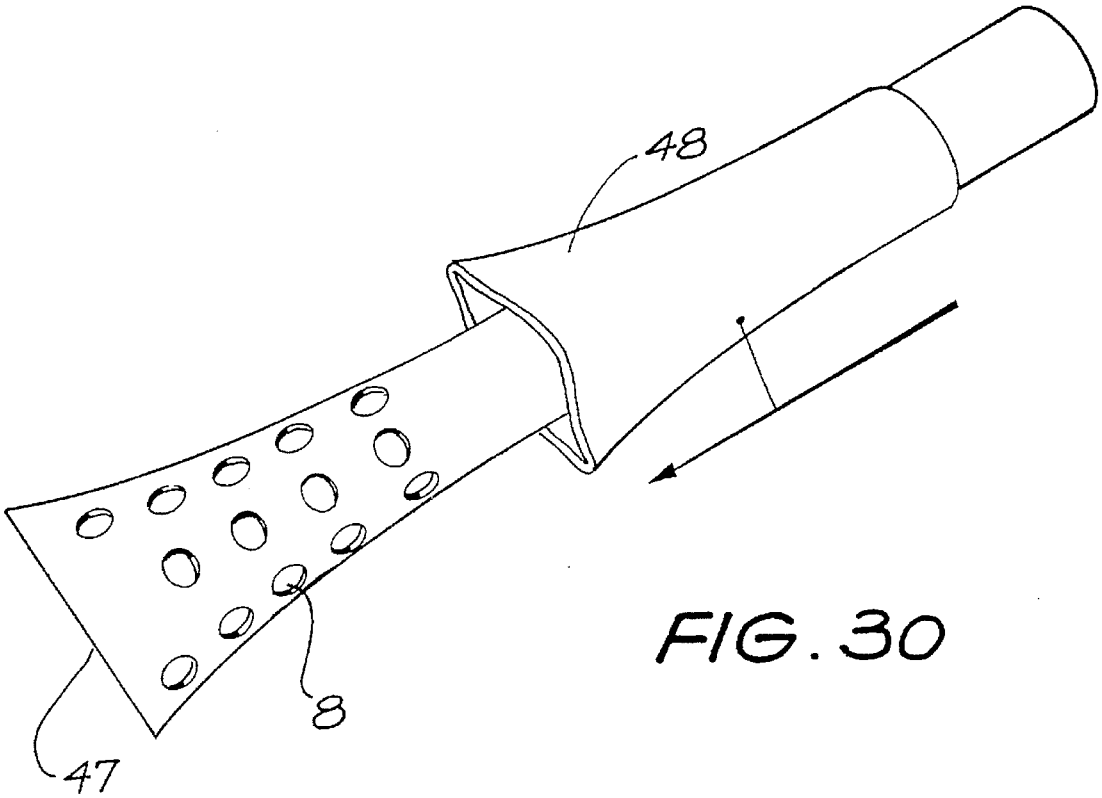
FIG. 30
FIG. 31
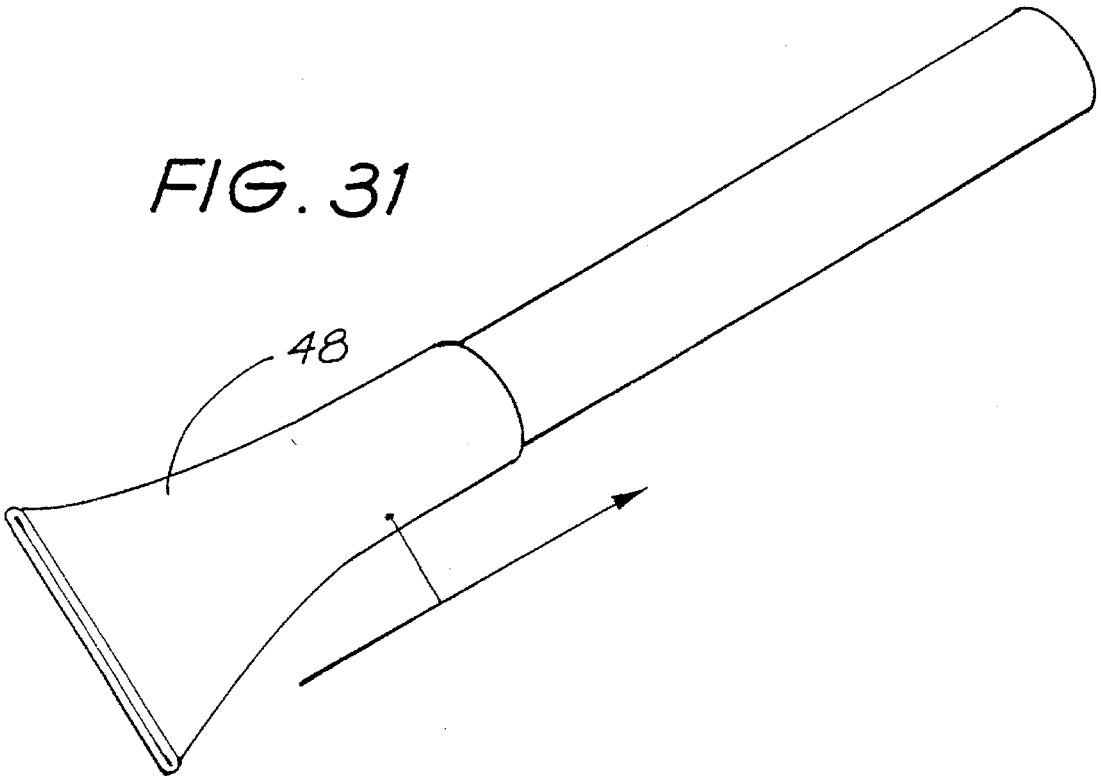

INFUSER

The present invention relates to an apparatus for holding a solid from which a substance, such as a flavour or a colour is to be extracted by immersion in a liquid. In particular the invention relates to an infuser for holding granular material such as coffee grounds or tea leaves or dust, to be brewed to obtain a flavoured drink.

It is well known to infuse the flavour extracts from coffee grounds or tea leaves to obtain a drink. The disposal of the spent grounds or leaves has been a problem.

To attempt to alleviate this problem, Thomas Sullivan in 1904, placed a predetermined mount of tea leaves in small silk bags which became known as "tea bags".

There are presently two types in the market place, the first being a flat rectangular package having a suing extending therefrom; the boiling water is poured over the teabag in a cup and the bag is moved up and down in the hot water by means of the string. When the desired flavour has been infused the "tea bag" removed by means of the string. The thus removed "tea bag" is soggy and messy, and the tea bag drips liquid when it is removed.

The second type is the flat circular bag which is placed in the bottom of the cup and boiling water is poured on top. The problem with this type is that it is difficult to control the extraction of the tea flavour, as the bag is left in the cup. Again removal of this bag is messy, due to the soggy nature of the spent bag.

Many attempts have been made to provide infusion units which contain a predetermined charge of tea or the like. For example Conrey U.S. Pat. No. 3,193,388, Thompson U.S. Pat. No. 4,806,369. However, these did not alleviate the problem of the soggy nature of the spent charge.

U.S. Pat. No. 3,102,465 attempted to overcome this problem by telescopically enclosing a perforated cylindrical infusion holding chamber, within a cylindrical sheath element, having a single open end which is enclosed by a closure means. The problem with this infusion unit is that it is not a disposable unit and is difficult to use without touching of the perforated cylindrical infusion holding chamber.

Further, these devices are complicated in their manufacture.

The present invention seeks to ameliorate the above disadvantages by providing an infuser, adapted to hold solids to infuse a substance into a liquid in which the infuser is immersed, comprising:

an elongated member having an outer surface and a gripping portion located at a first end;

an infusion charge holding chamber located at or adjacent the other end of the elongated member, and having perforations or porous material therealong communicating between the chamber and the said outer surface;

an external sleeve adapted to move along or over said elongated member such that in a first position the perforations are exposed, whereby, in use, with the infusion charge held in said chamber, when said chamber is immersed in a desired liquid, infuses a substance into the liquid, while in a second position the sleeve covers the perforations or porous material to resist leakage of liquid from said chamber, said sleeve and said elongated member being so dimensioned that, in use, the elongated member is held by a user, at the grip portion and the sleeve moved along or over said elongated member, without the need for the user to touch the perforations or porous material of the infusion charge holding chamber.

The invention will now be described by way of example with reference to the accompanying drawings in which.

Figure 4A:
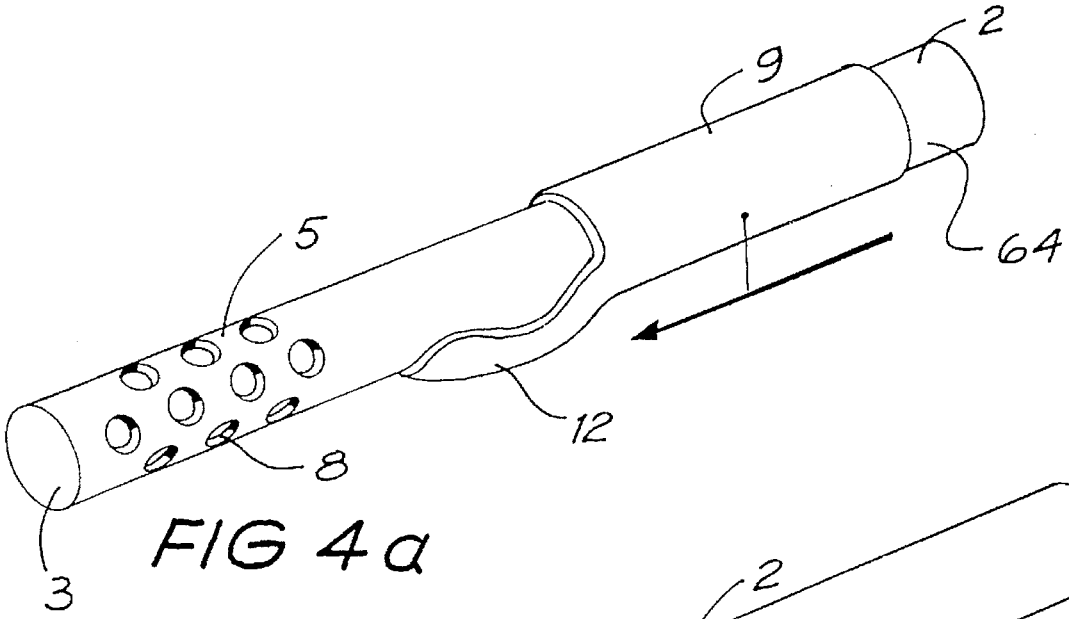
Figure 4B:
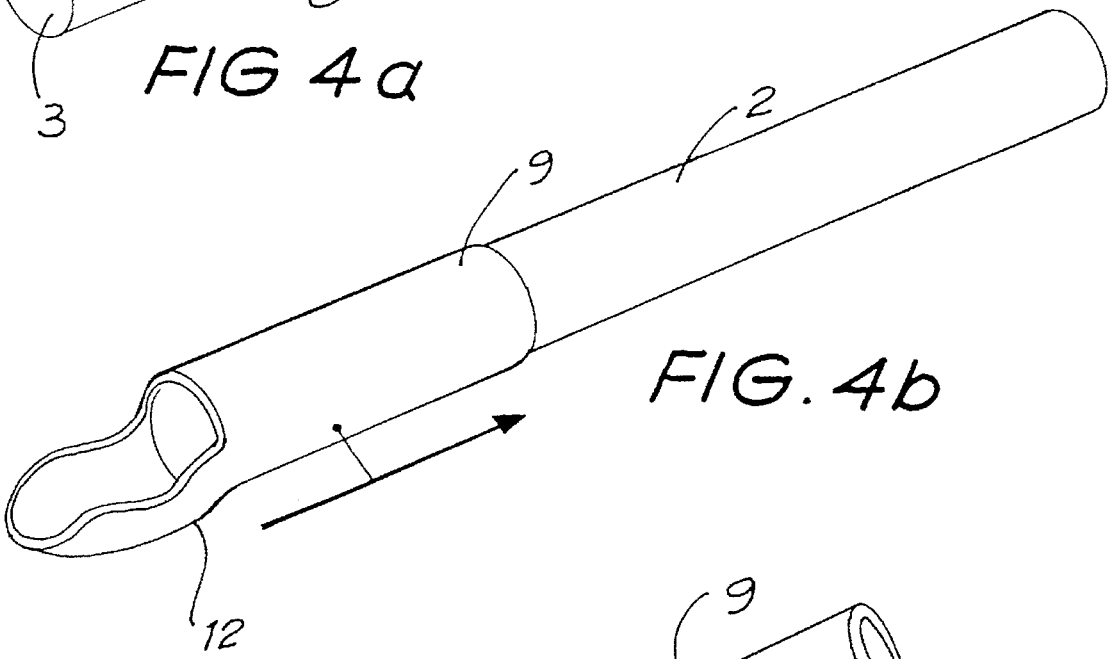
Figure 5:
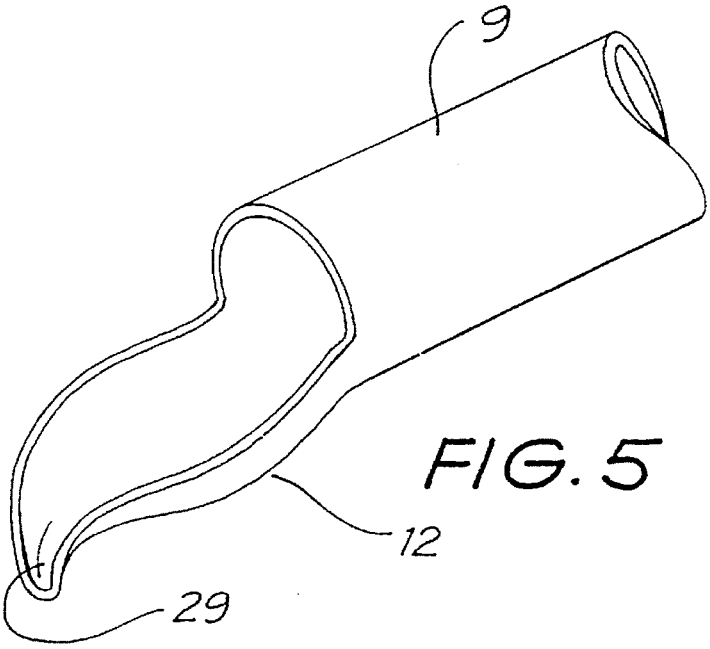

FIGS. 4*a* and 4*b* illustrate another embodiment of the present invention, wherein the sleeve has a spoon-element integral therewith;

FIG. 5 illustrates a close up view of the spoon of the embodiment illustrated in FIGS. 4*a* and 4*b;*

Figure 6:
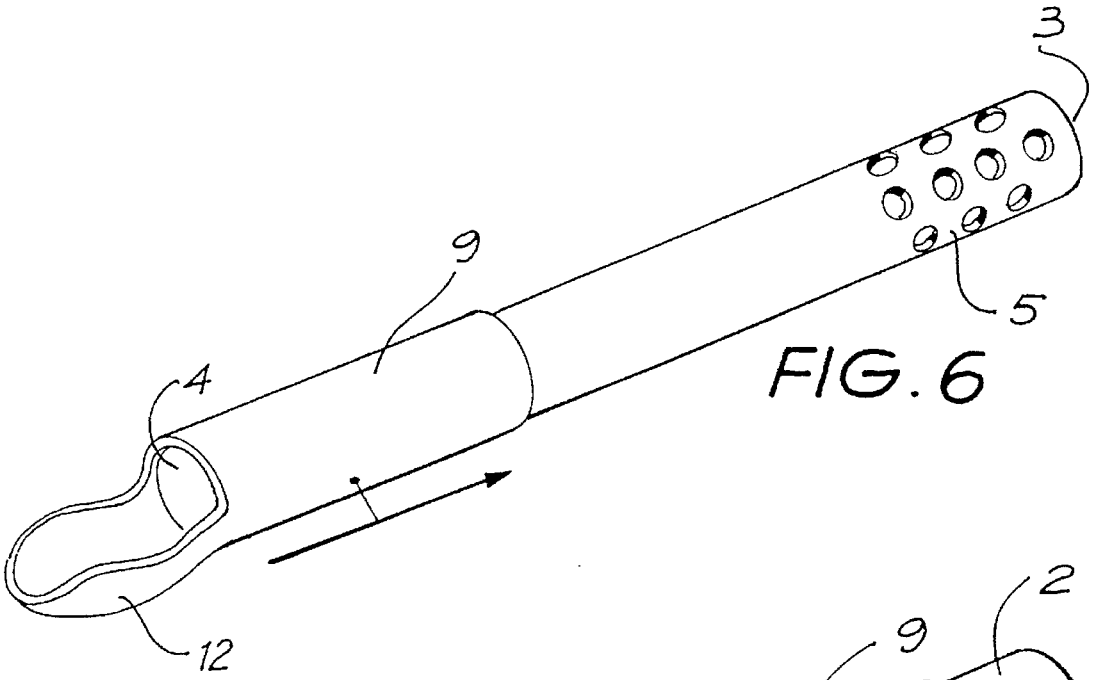

FIG. 6 illustrates a variation of the embodiment shown in FIGS. 4*a* and 4*b;*

Figure 7:
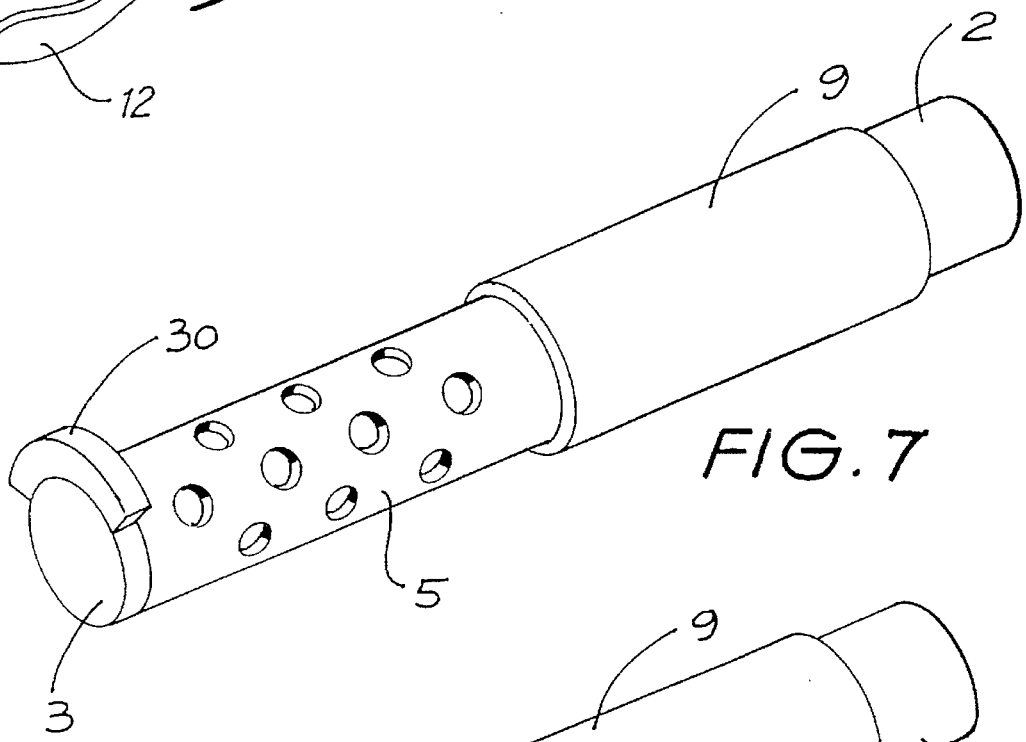
Figure 8:
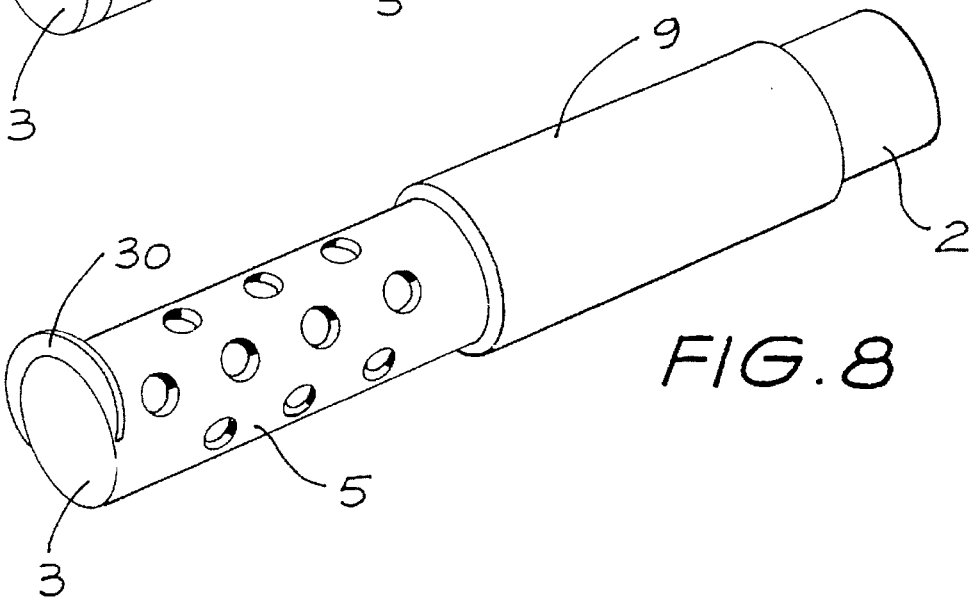
Figure 9A:
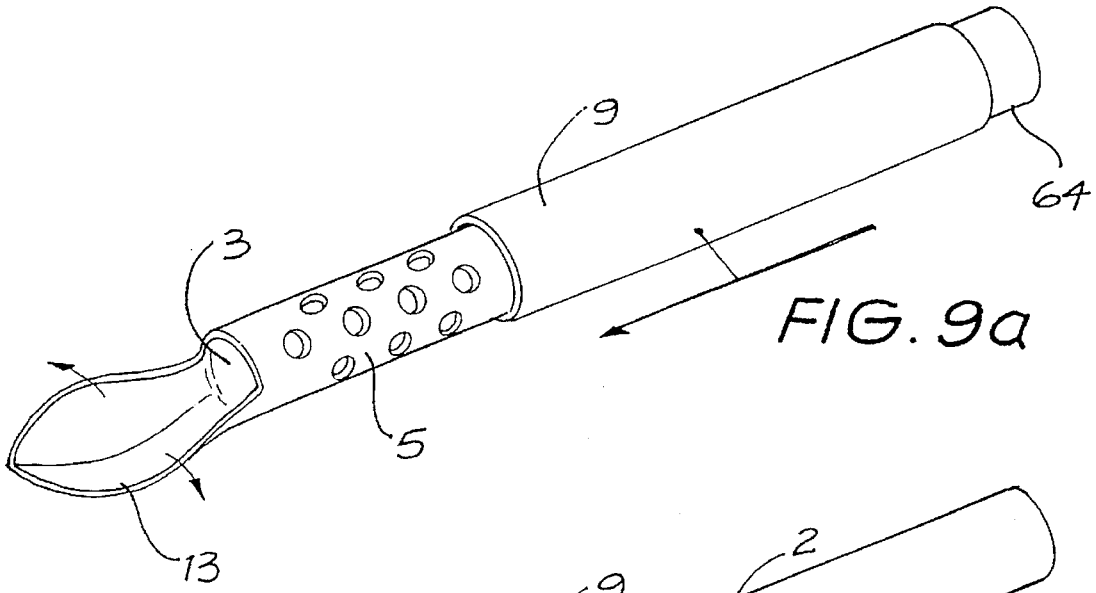
Figure 9B:
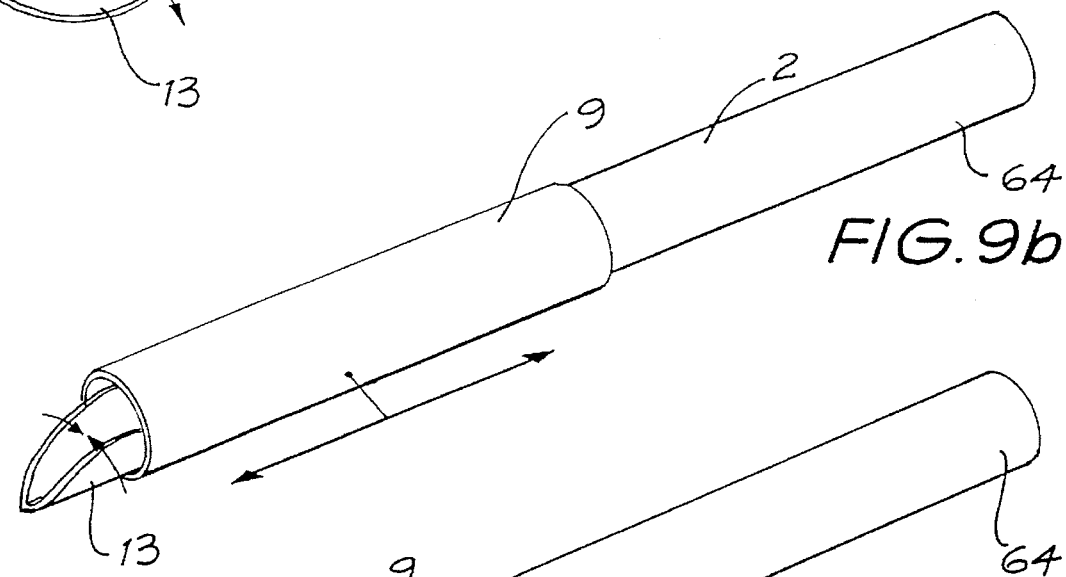
Figure 9C:
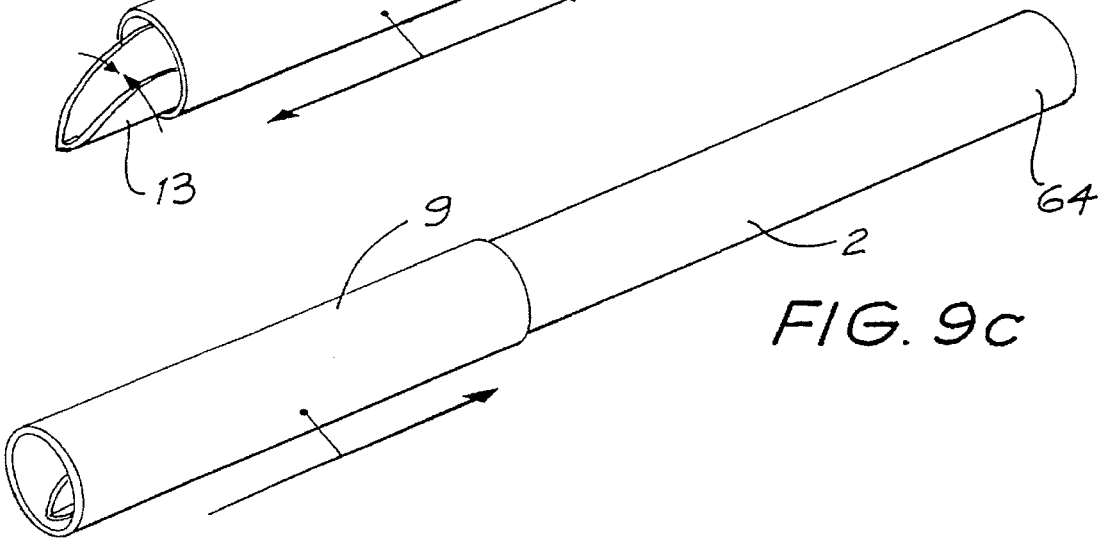
Figure 10:
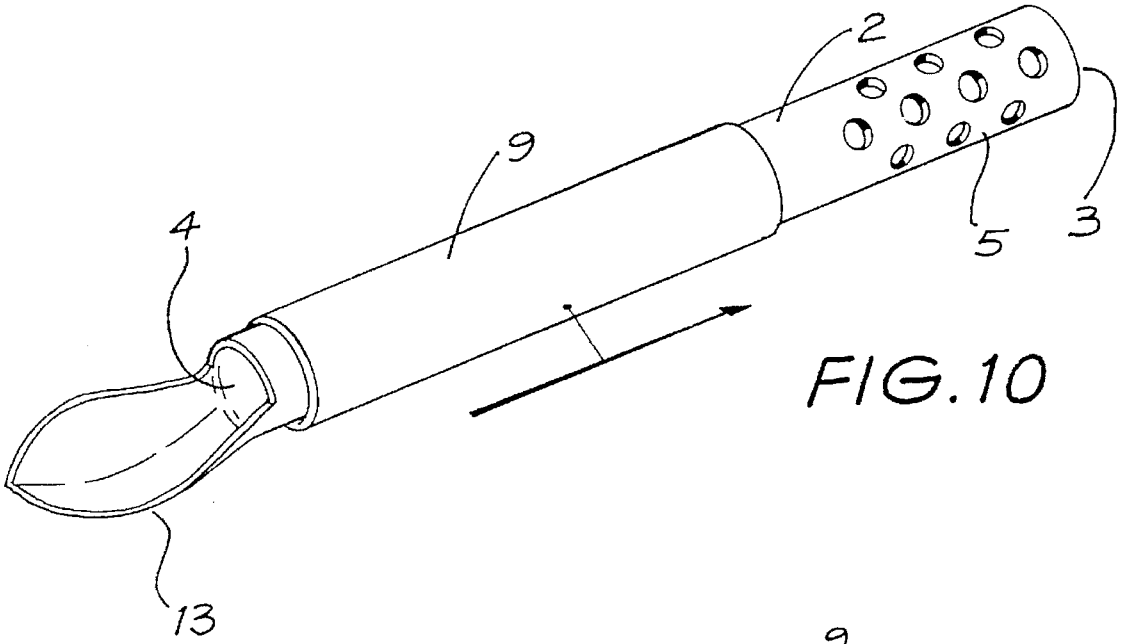

FIGS. 7 and 8 illustrate details of the end portion of embodiments of the present invention;

FIGS. 9*a* to 9*c* illustrate a further embodiment of the present invention wherein a spoon element is integral with the main body of the infuser;

FIG. 10 illustrates a variation of the embodiment of FIG. 9*a*, 9*b* and 9*c;*

Figure 1:
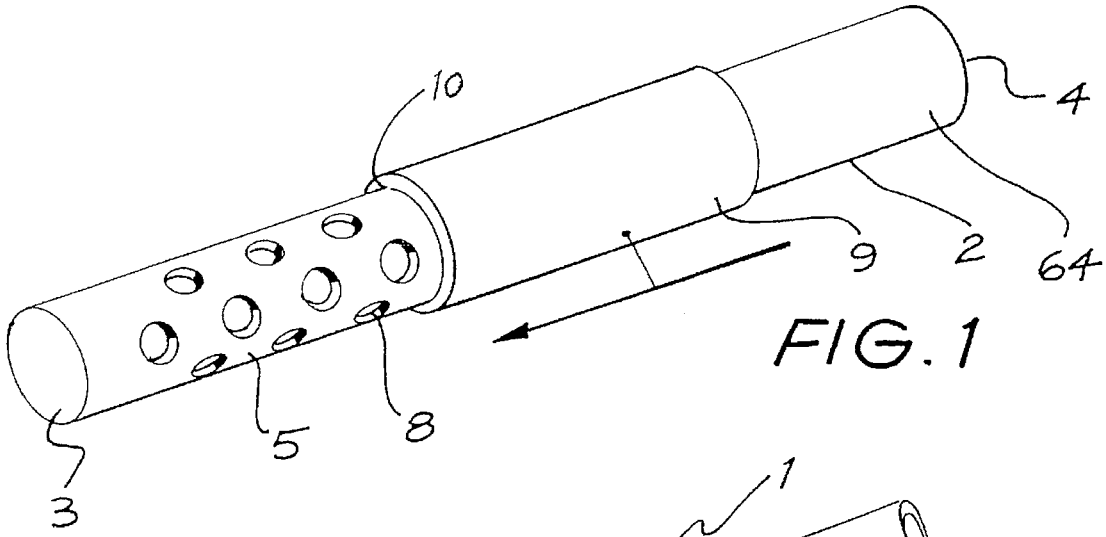
FIG. 1 illustrates schematically a flavour infuser container according to one embodiment of the present invention.
Figure 2:
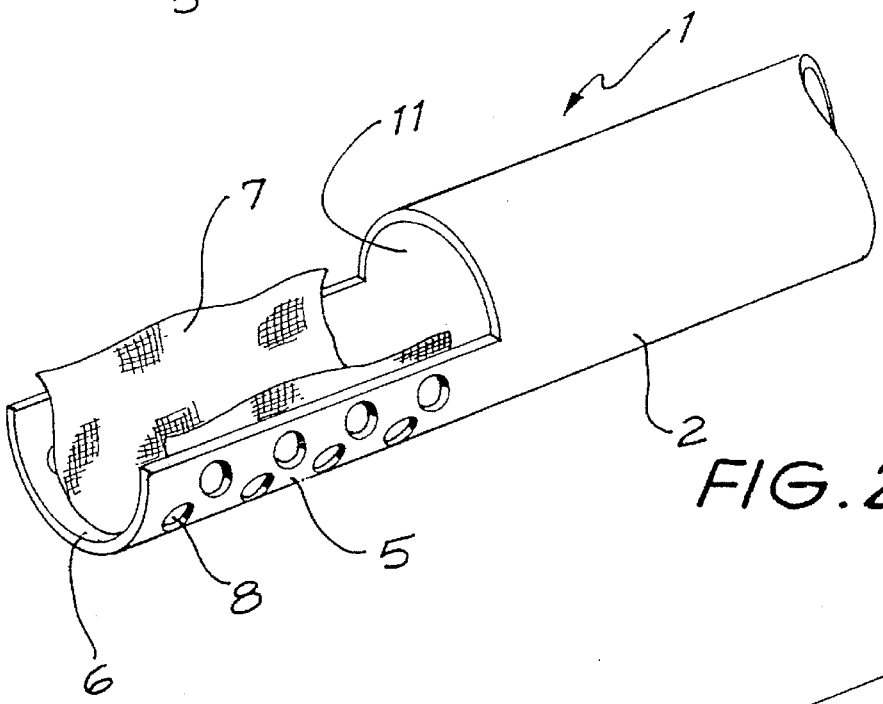
FIG. 2 illustrates a pan sectional view of the particulate holding chamber of the flavour infuser shown in FIG. 1.
Figure 11:
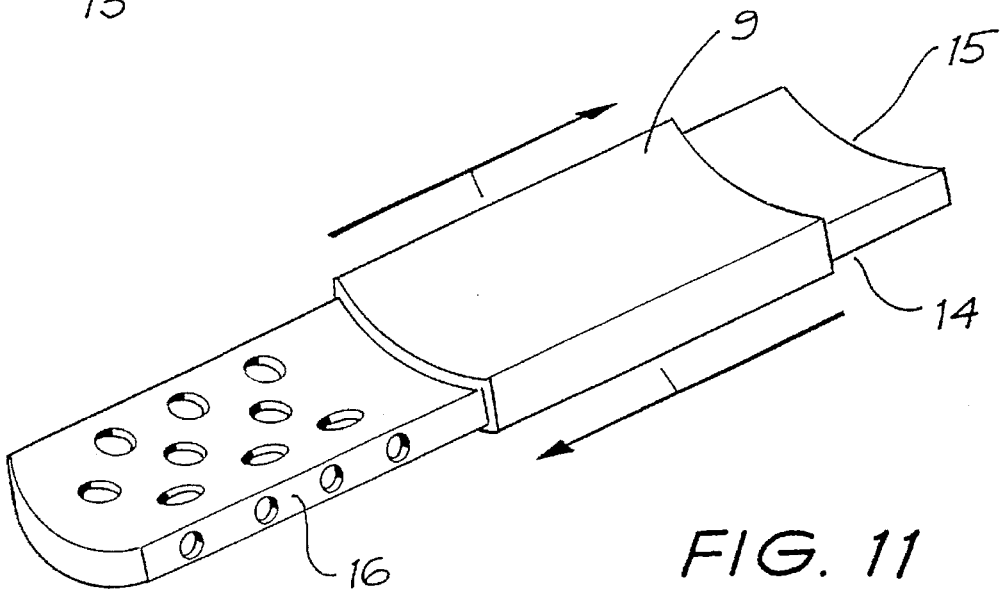
Figure 12A:
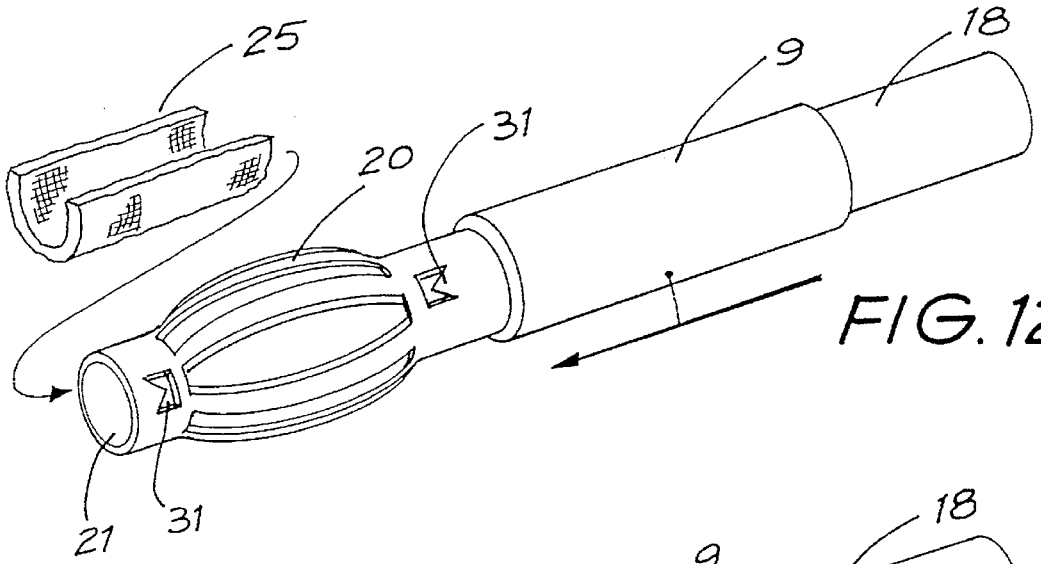
Figure 12B:
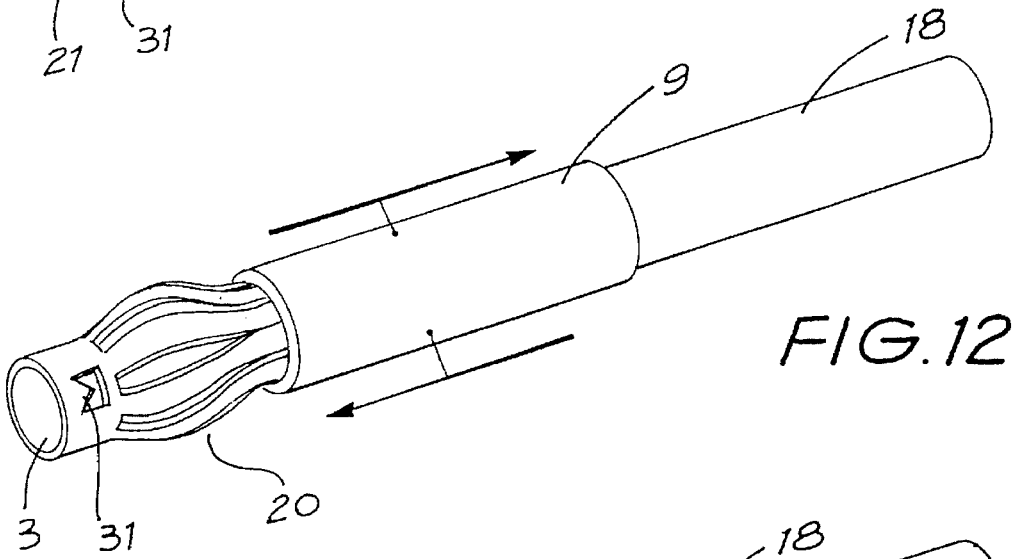
Figure 12C:
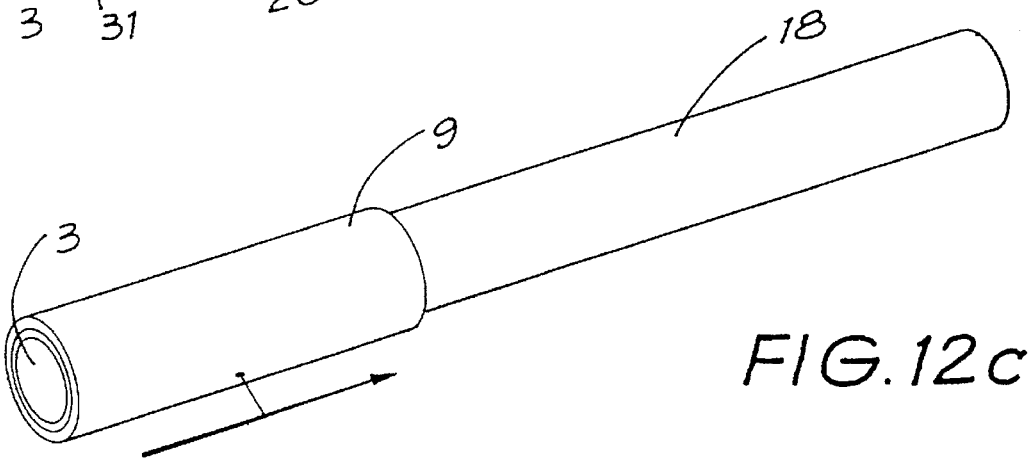
Figure 13A:
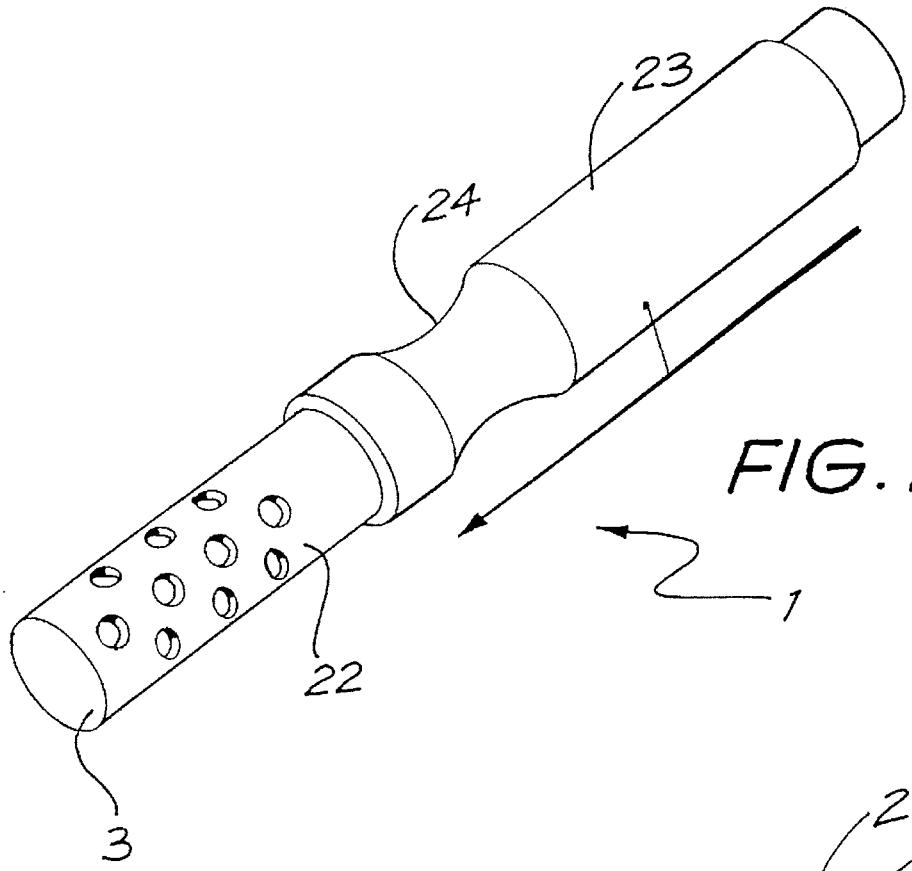
Figure 13B:
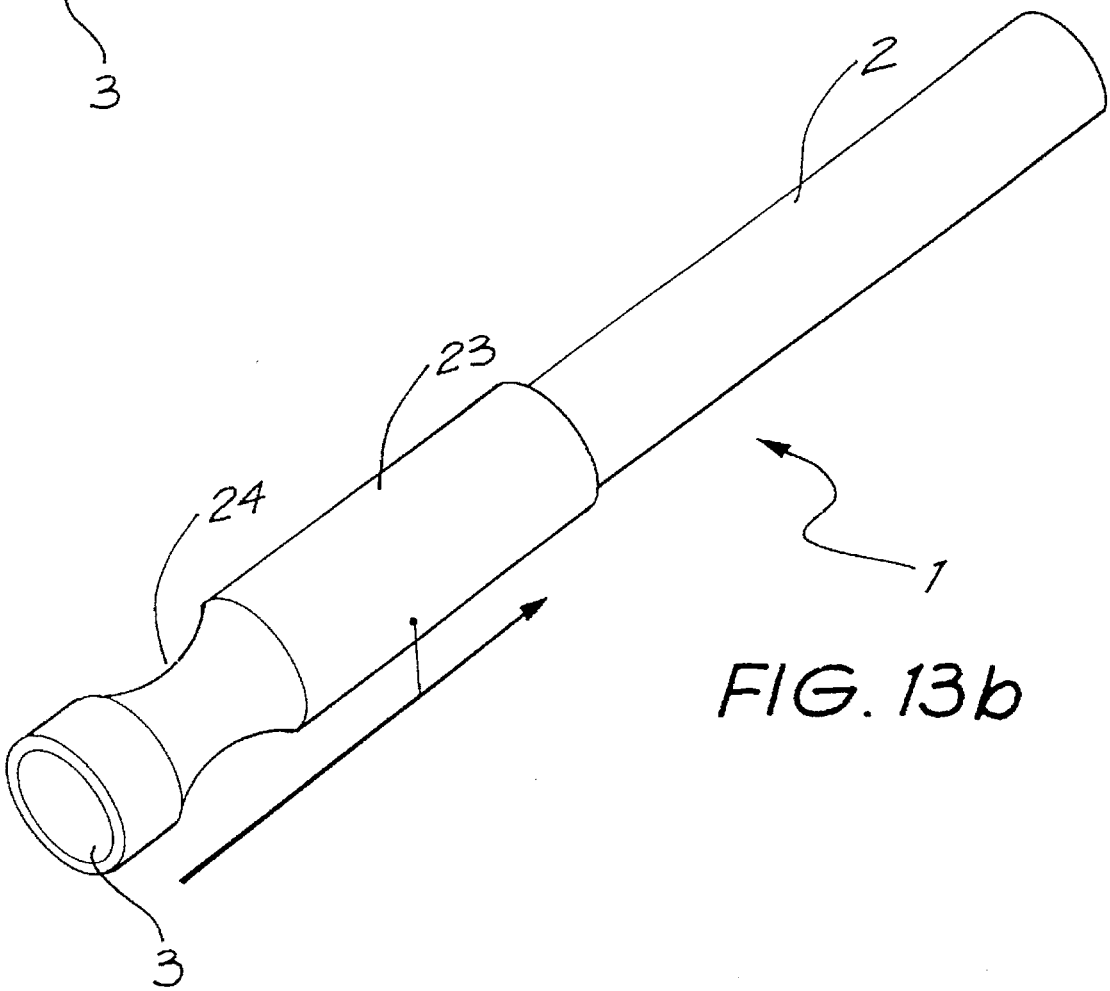
Figure 21:
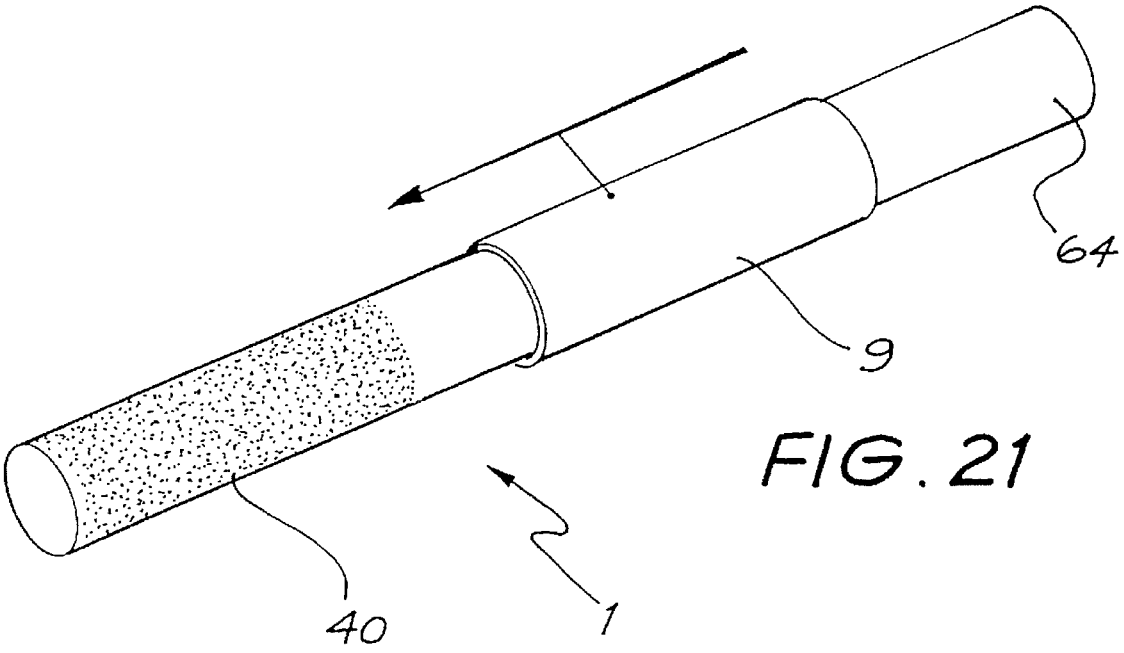
Figure 22:
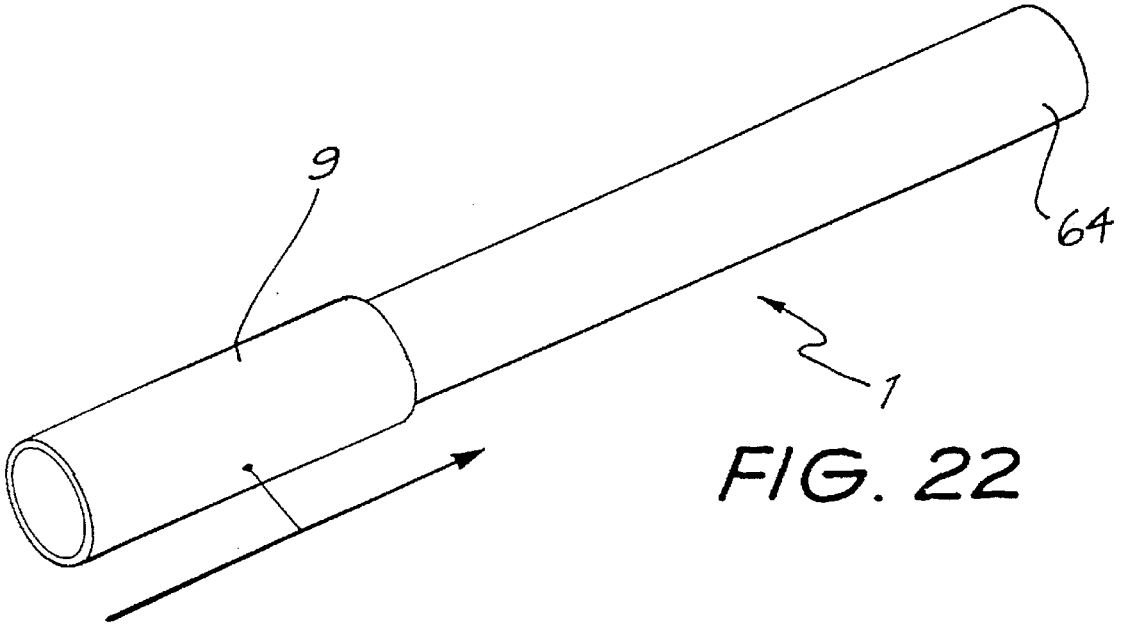
Figure 23:
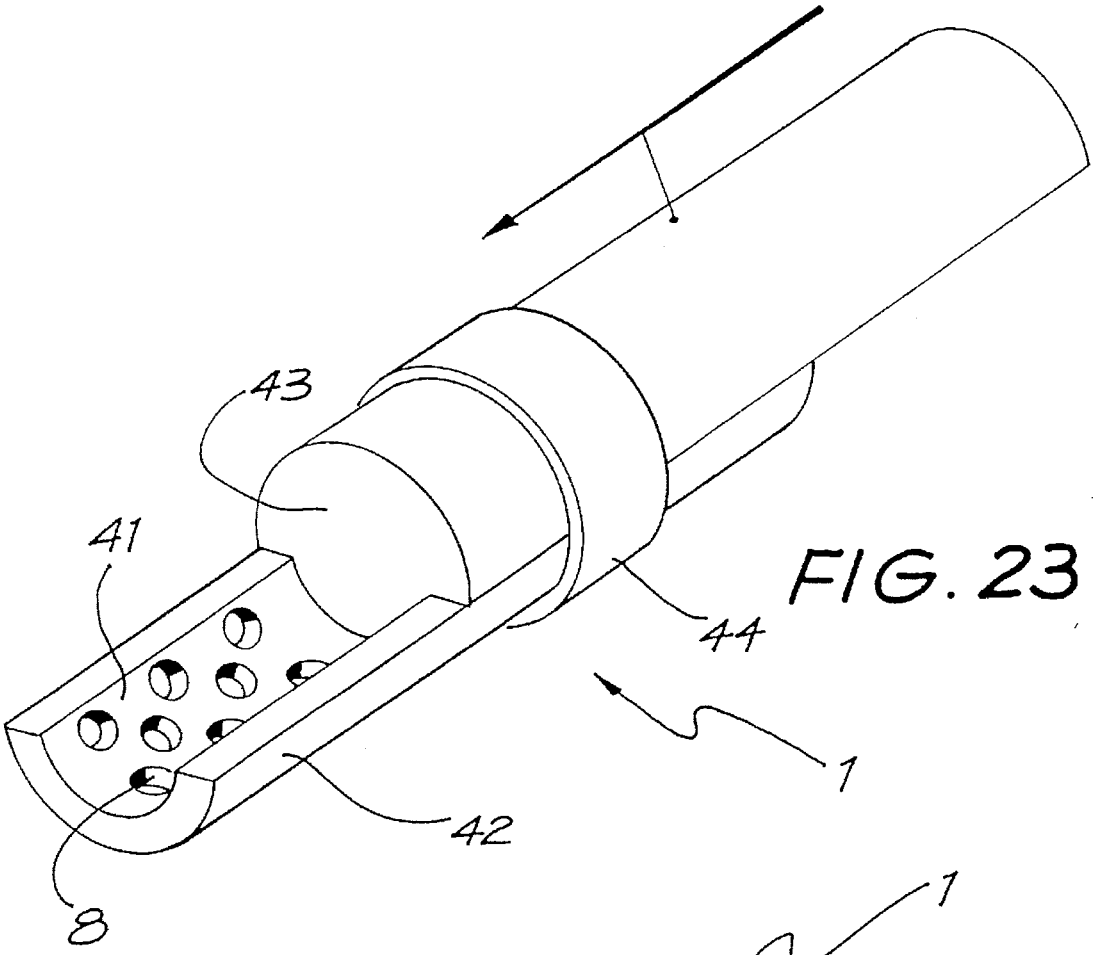
Figure 24:
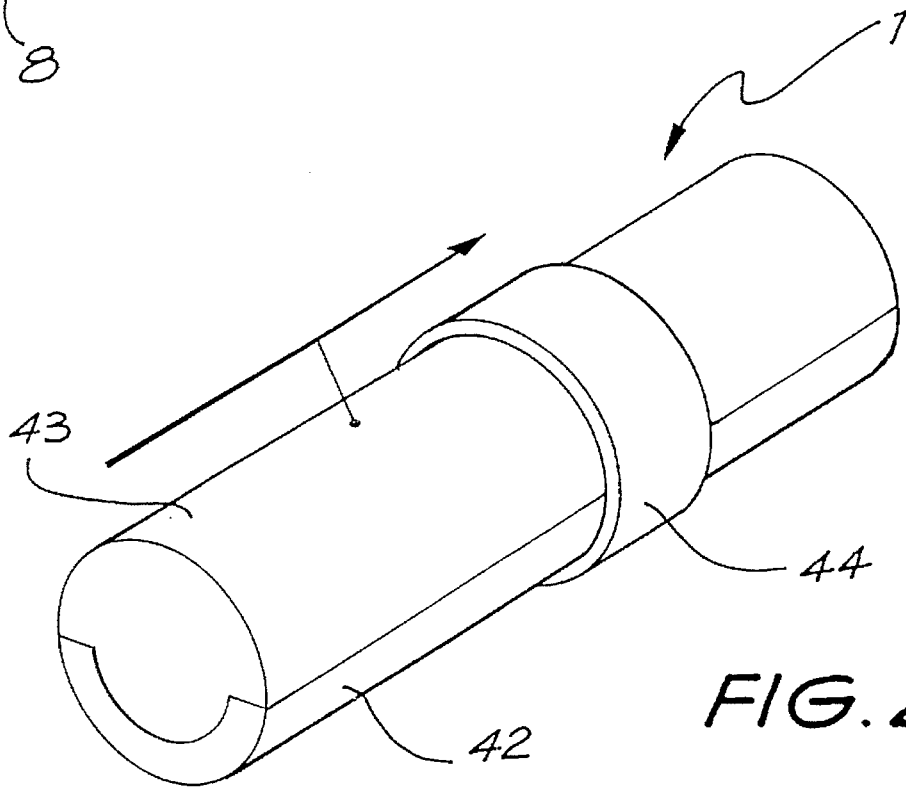
Figure 25:
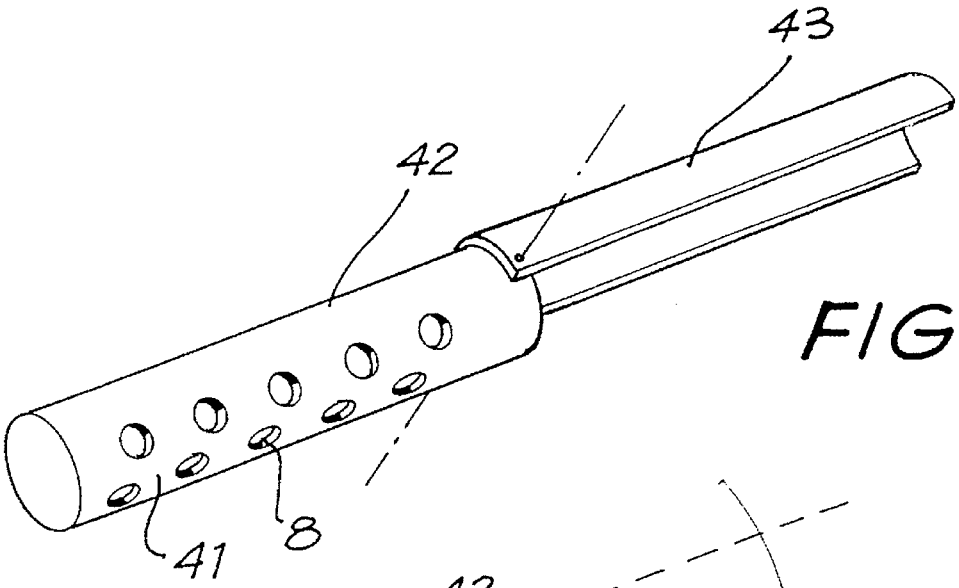
Figure 26:
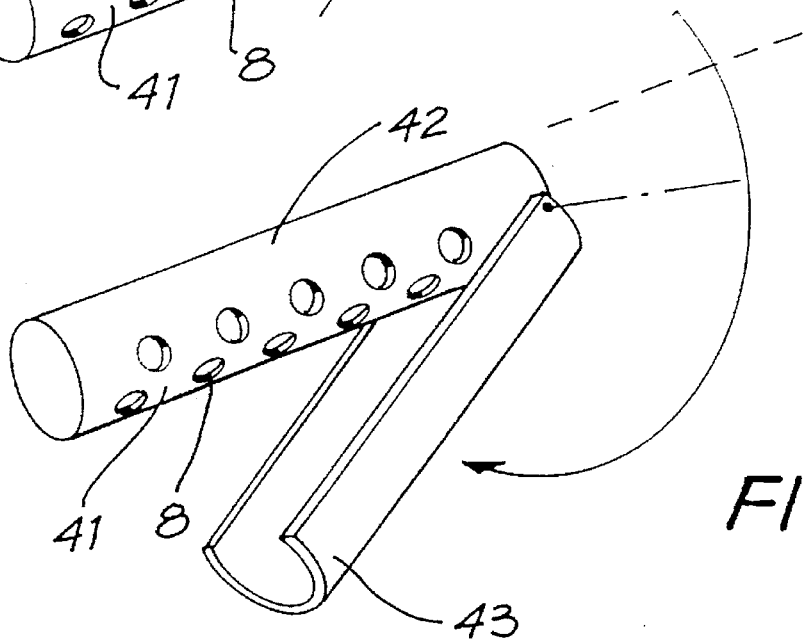
Figure 27:
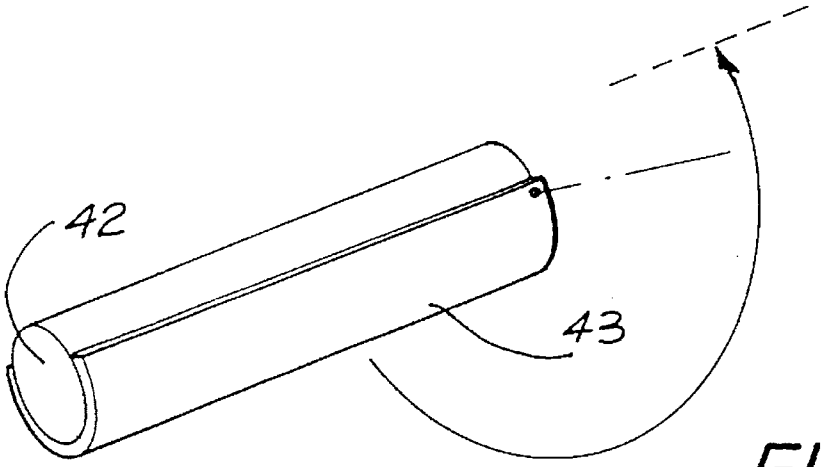
Figure 28:
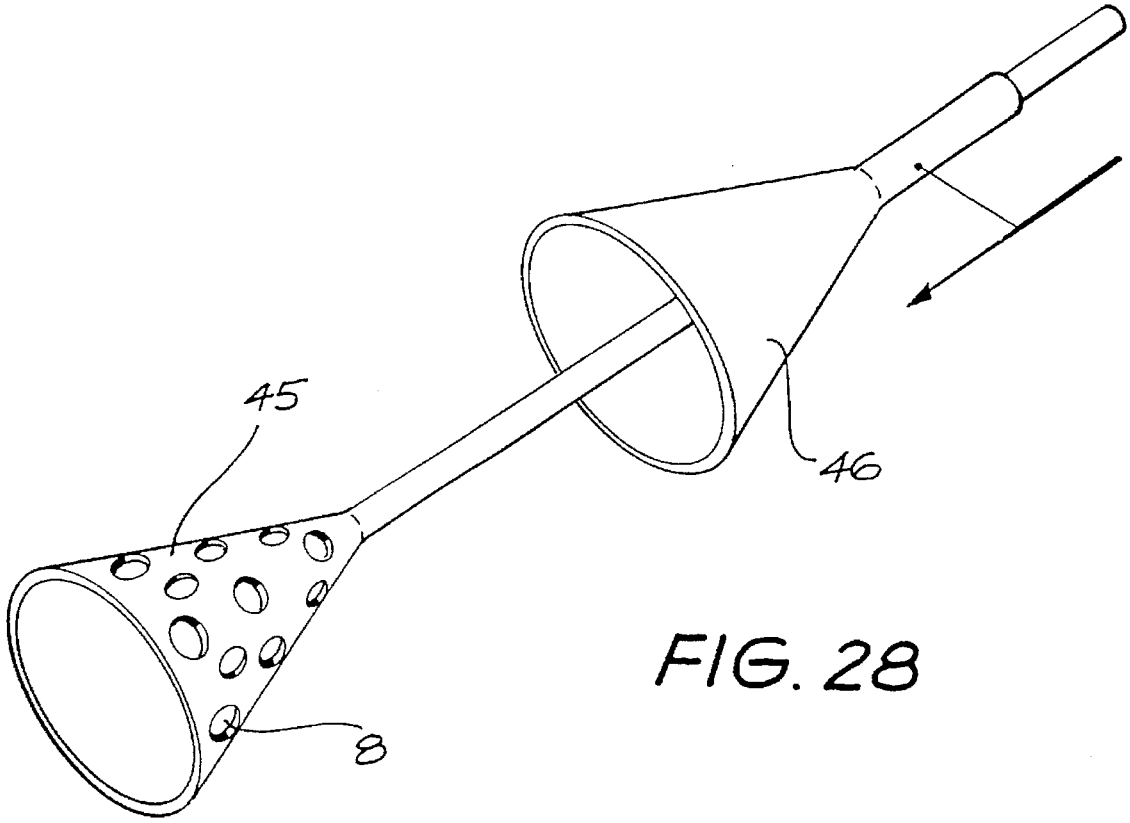
Figure 29:
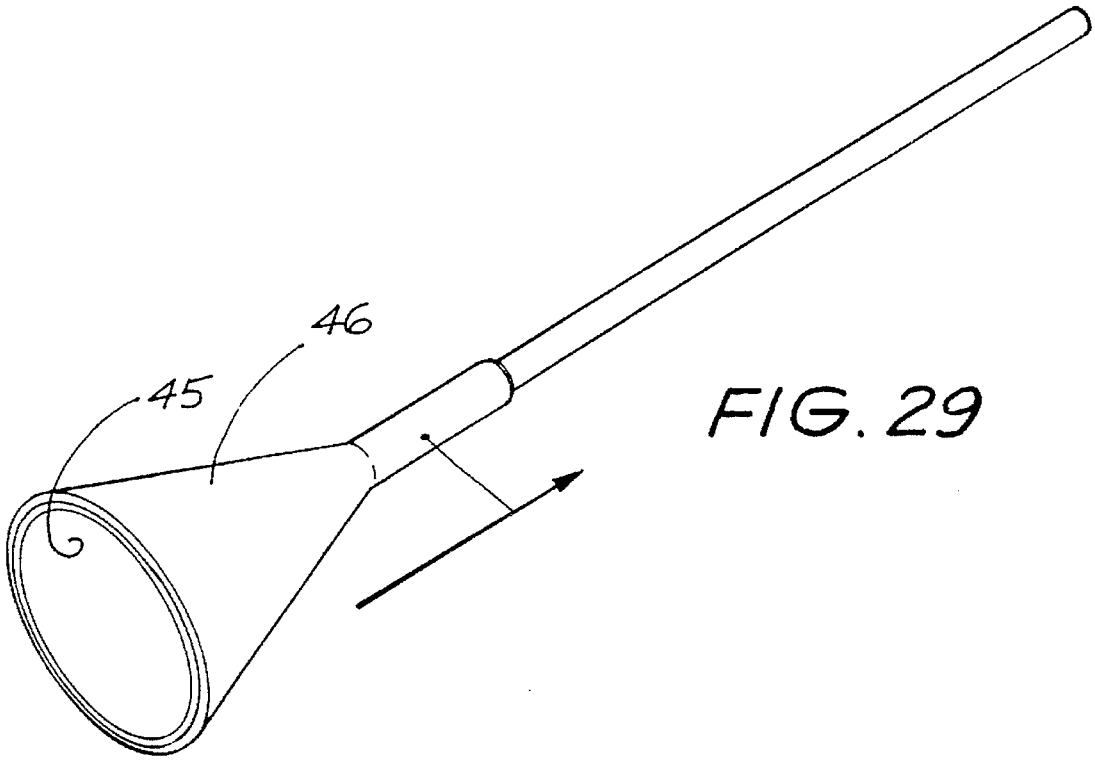
Figure 32:
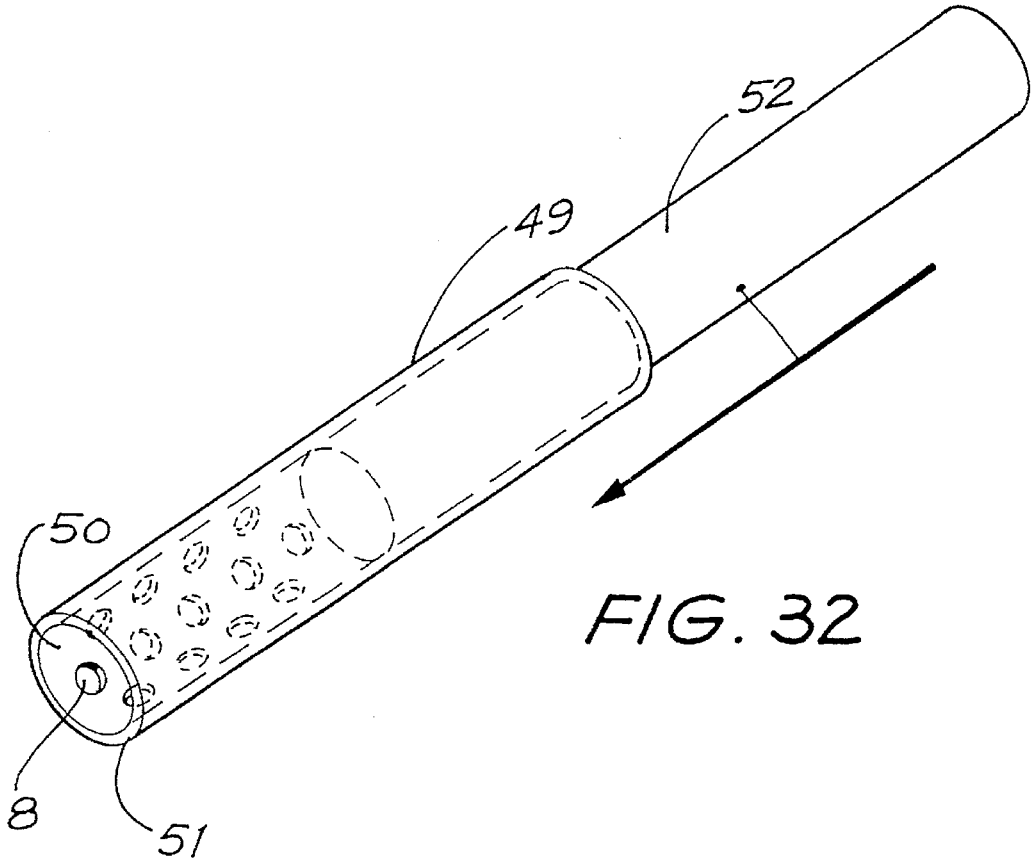
Figure 33:
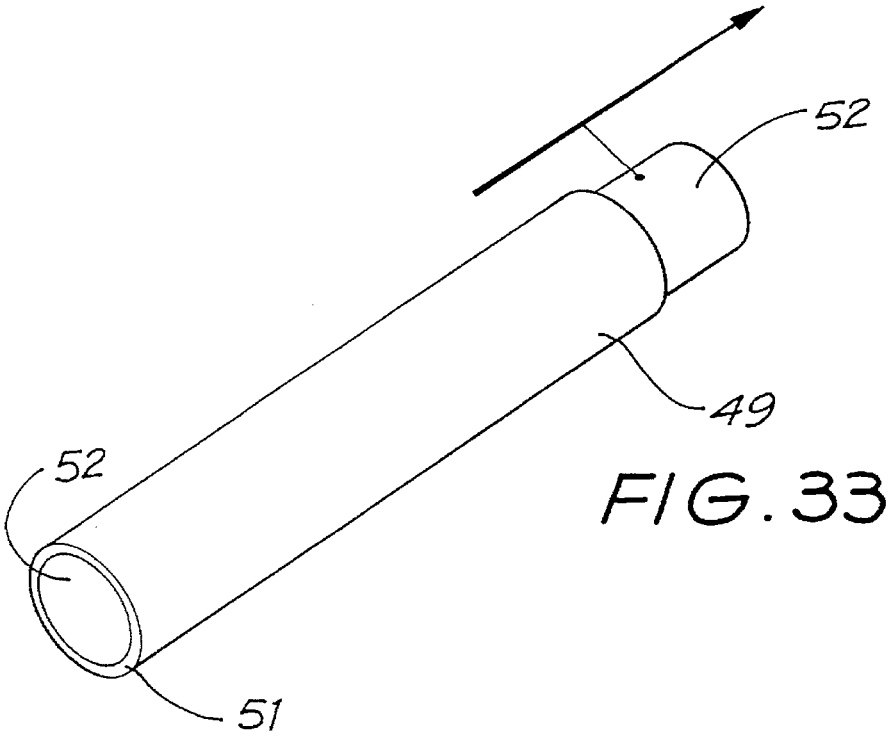
Figure 34:
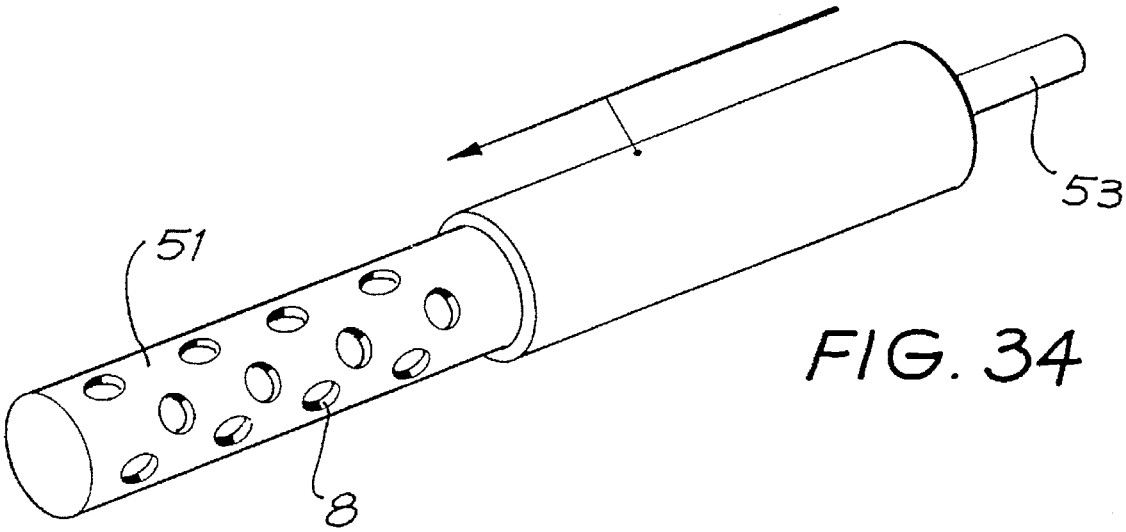
Figure 35:
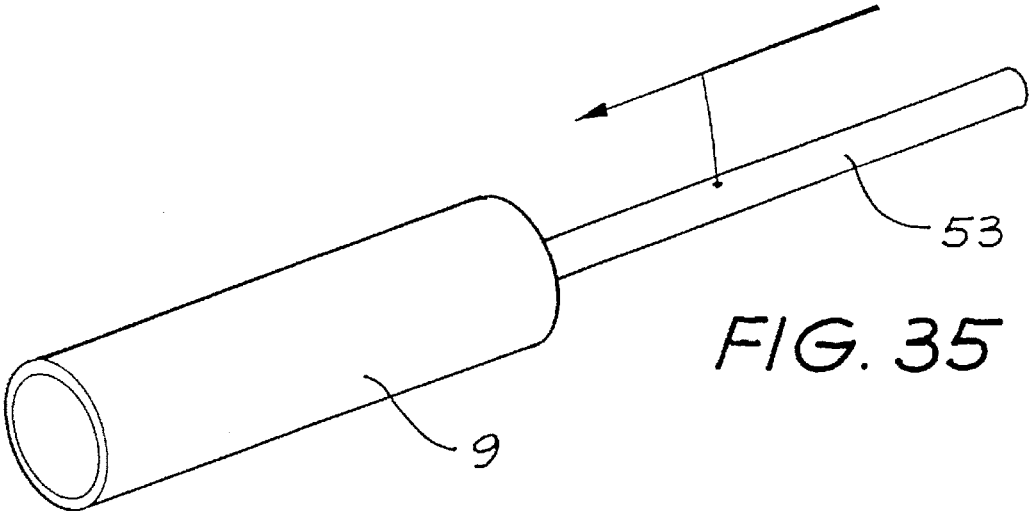
Figure 36:
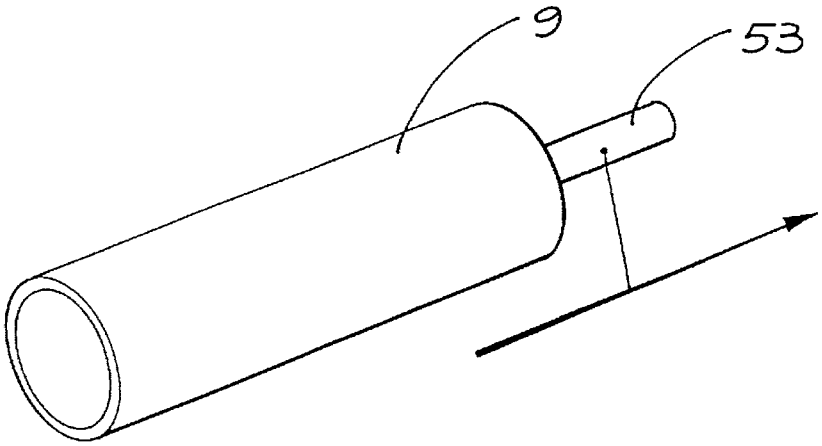
Figure 37:
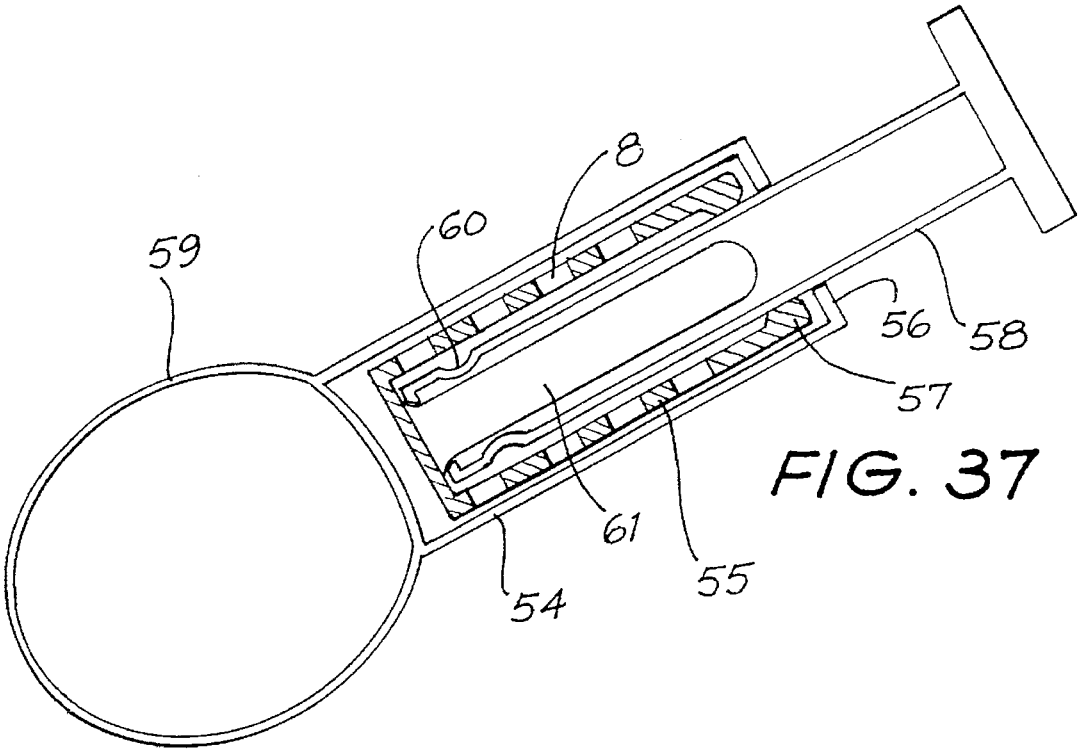
Figure 38:
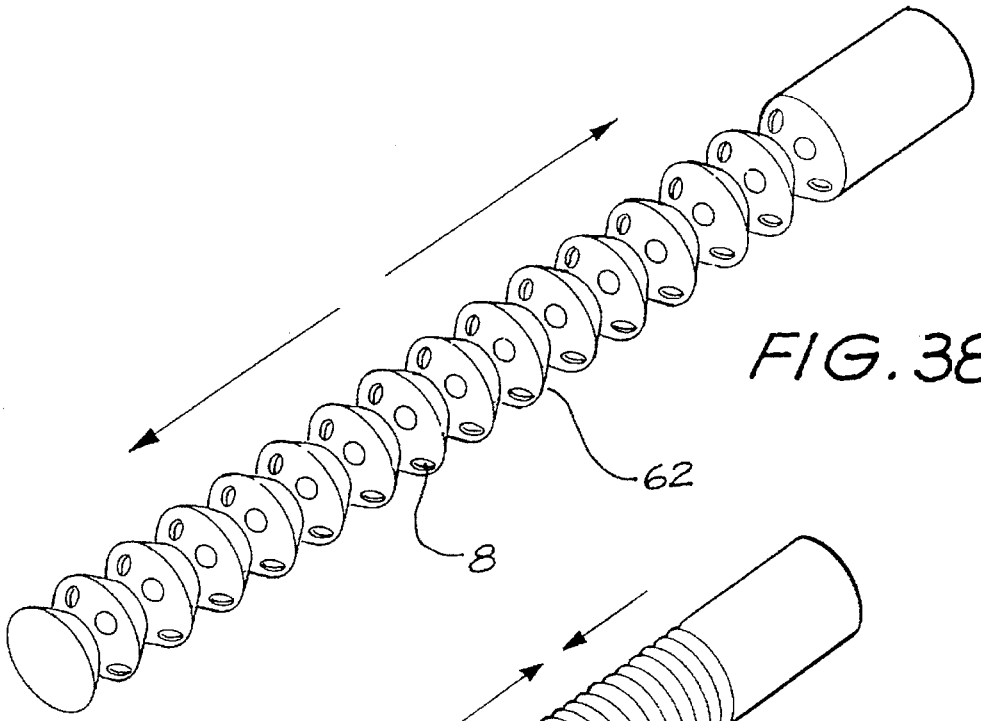
Figure 39:
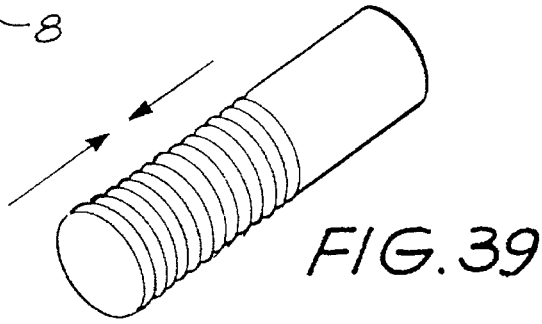
Figure 40:
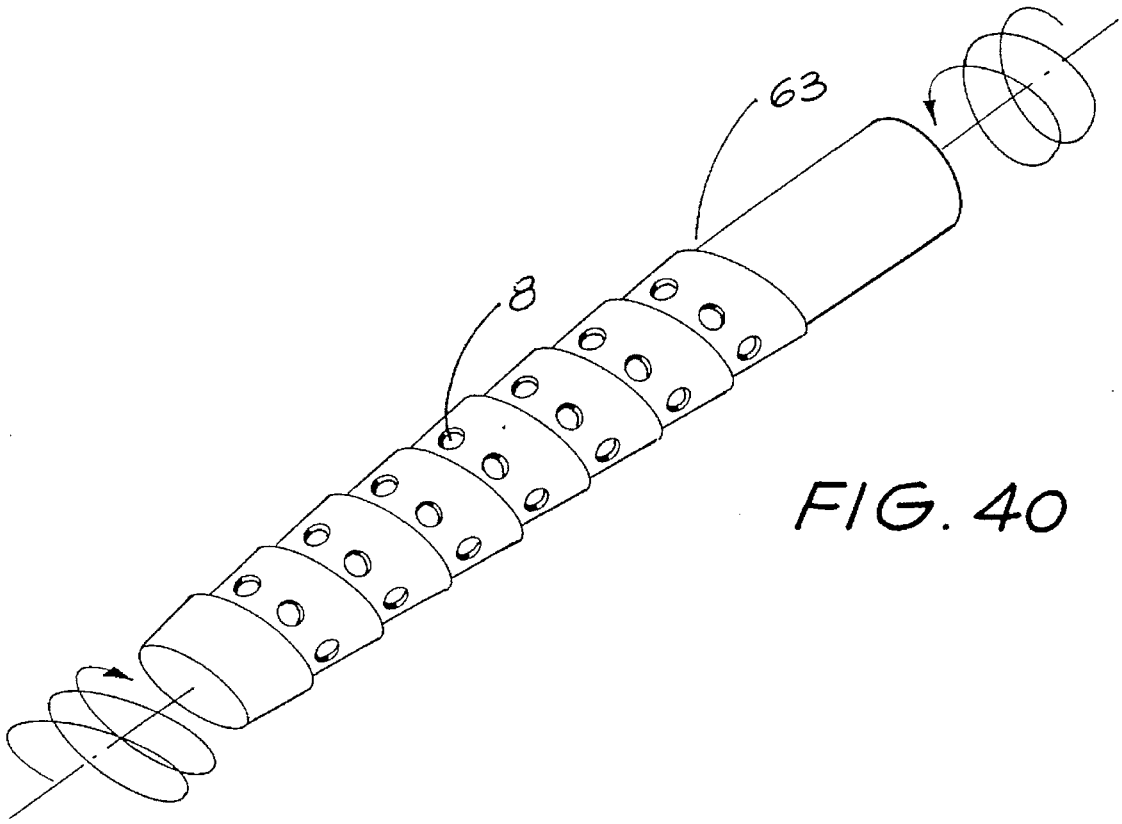
Figure 41:
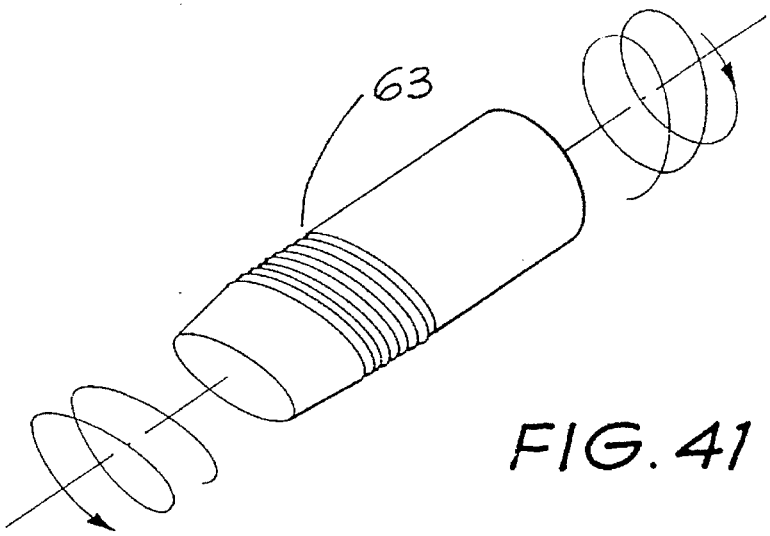
Figure 42:
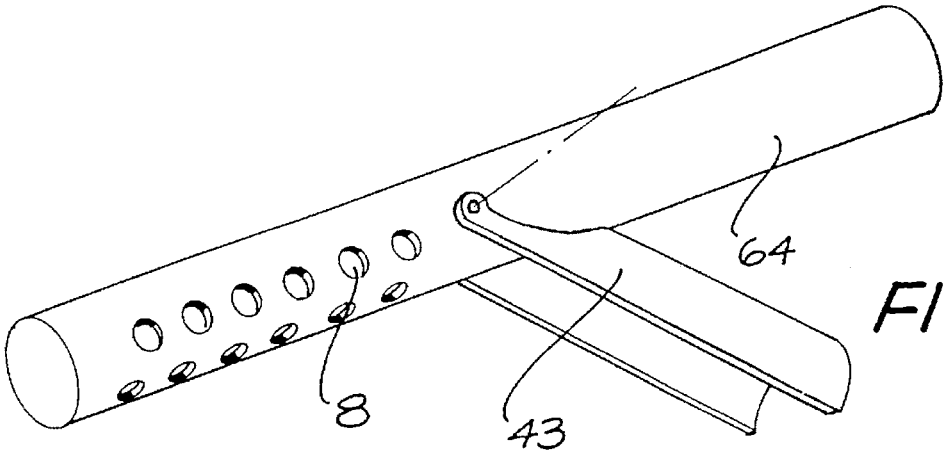
Figure 43:
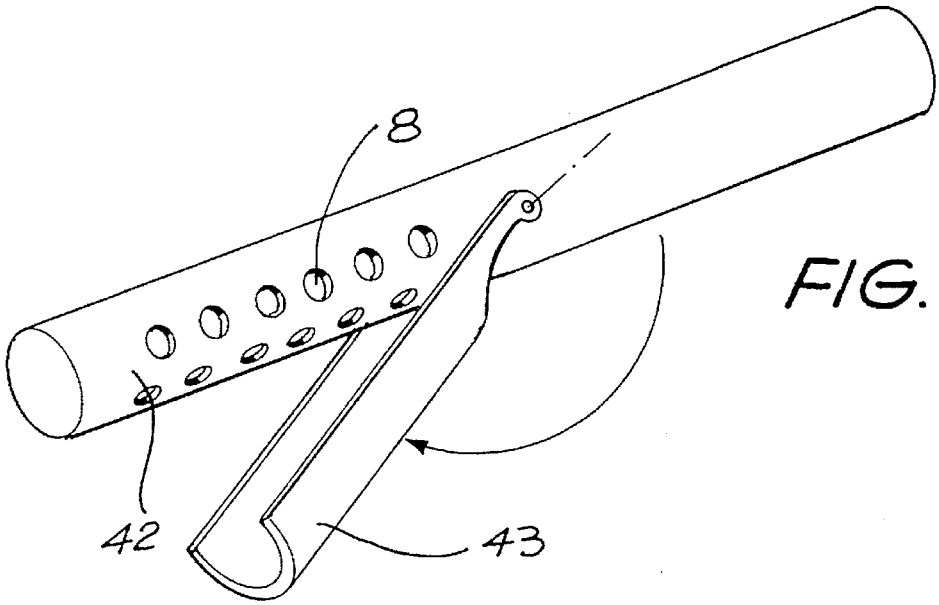
Figure 44:
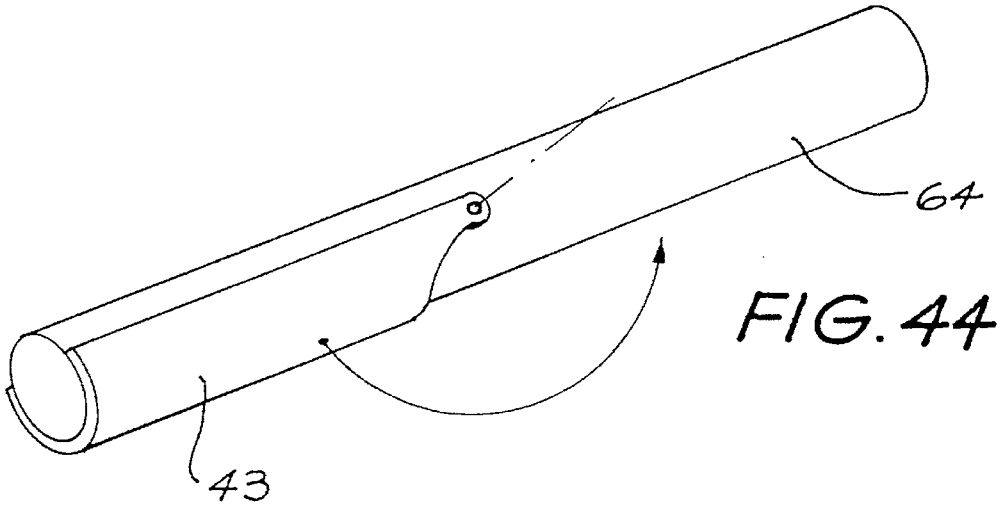
Figure 45:
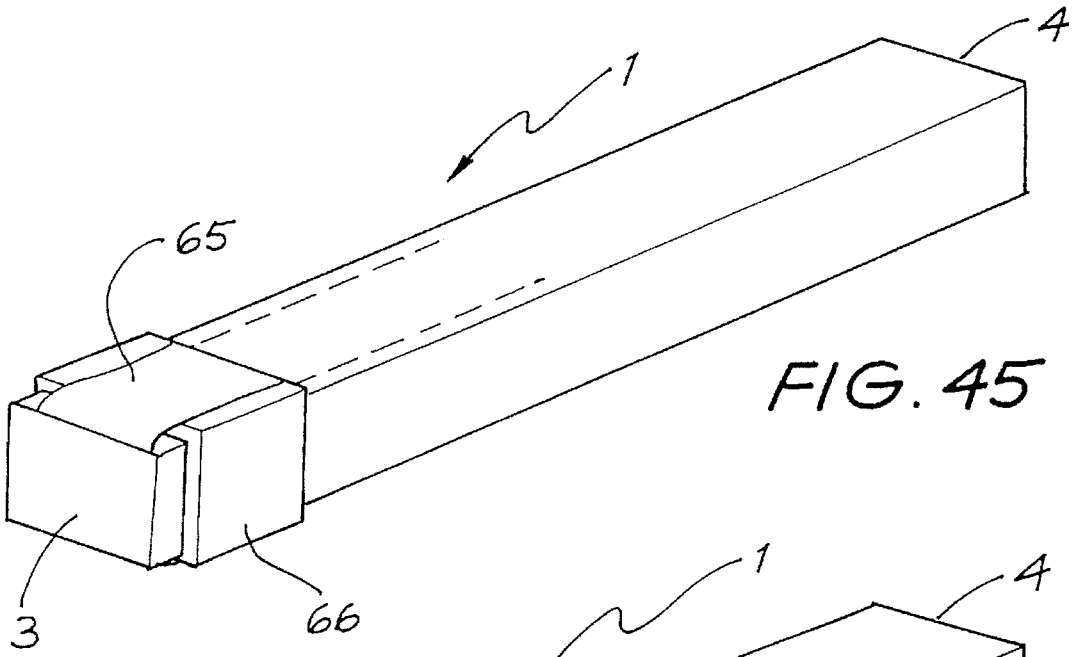
Figure 46:
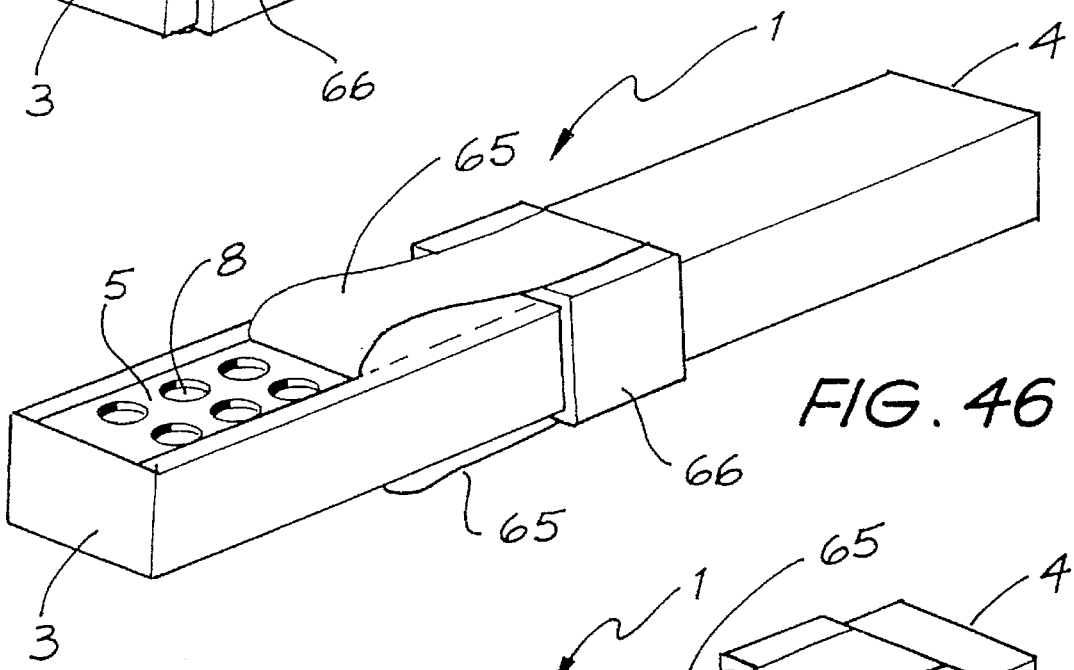
Figure 47:
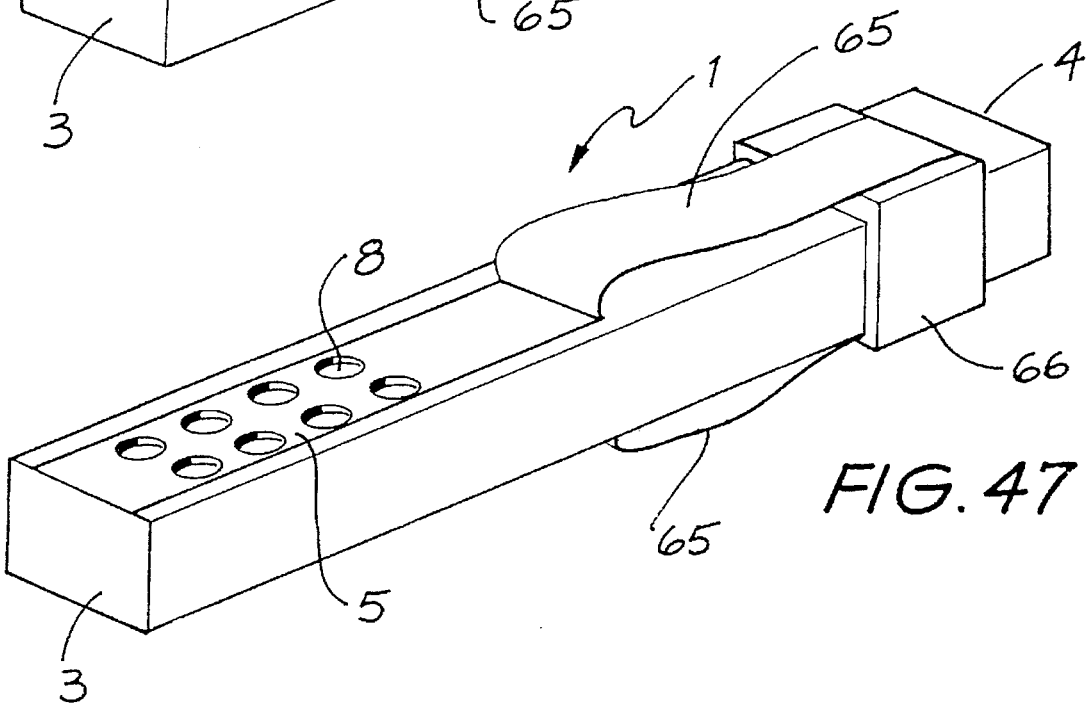

FIG. 11 illustrates further embodiment of the present invention in which the infuser body is shaped to act as a spoon;

FIGS. 12*a*, 12*b* and 12*c* illustrate an refuser of yet a further embodiment of the present invention;

FIGS. 13*a* and 13*b* illustrates an infuser according to yet a further embodiment of the present invention;

FIGS. 14*a* and 14*b*, 15*a*, 15*b* 16 & 17 illustrate furthers embodiment of the present invention with particulate material cartridges packaged as modular units;

FIGS. 18, 19*a* and 19*b* and 20*a* and 20*b* illustrate yet further embodiments of the present invention;

FIGS. 21 and 22 illustrating a modified version of the embodiment illustrate in FIGS. 1 and 2;

FIGS. 23 and 24 illustrates an embodiment of the present invention in which the infusion charge holding chamber is arcuate;

FIGS. 25, 26 and 27 illustrate an embodiment of the present invention, having a folding sleeve;

FIGS. 28 and 29 illustrate an embodiment of the present invention having a conical infusion charge holding chamber;

FIGS. 30 and 31 illustrate a further embodiment of the present invention;

FIGS. 32 and 33 illustrate a further embodiment utilizing an annular shaped infusion charge holding chamber;

FIGS. 34, 35 and 36 illustrate a further embodiment of the present invention;

FIGS. 37 illustrates a variation of the infuser shown in FIGS. 34, 35 and 36;

FIGS. 38 and 39 illustrate yet a further embodiment of the present invention;

FIGS. 40 and 41 illustrates yet a further embodiment of the present invention;

FIGS. 42, 43 and 44 illustrate a variation on the embodiment shown in FIGS. 25, 26 and 27; and FIGS. 45 to 47 illustrates yet another embodiment of the present invention.

As shown in FIG. 1 one embodiment of the present invention provides an infuser (1) suitable for brewing tea. The infuser comprises a cylindrical housing (2) having sealed ends (3 & 4). Located adjacent the sealed end (3) is a perforated wall portion (5). Located at the end (4) is a gripping portion (64). As shown in FIG. 2, the inner surface (6) of the wall portion (5) is lined with a porous material (7) which retains the particulate material, in this case tea leaves or dust, within the infuser (1), yet when the refuser is placed in a suitable fluid, the flavour solution passes through the porous material (7) and out through the perforations (8). Because of the elongated nature of the housing (2). The user grips the gripping portion (64) in one hand and slides the sleeve (9) with his other hand towards the gripping portion (64). The thus exposed perforated wall portion (5) of the infuser (1) is immersed in the cup of boiling water and stirred around by means of the gripping portion (64), which action readily assists in the extraction of the flavour from the tea leaves. Further it is easier to control the amount of extraction and hence the strength of the tea as opposed to some of the prior art.

Figure 3:
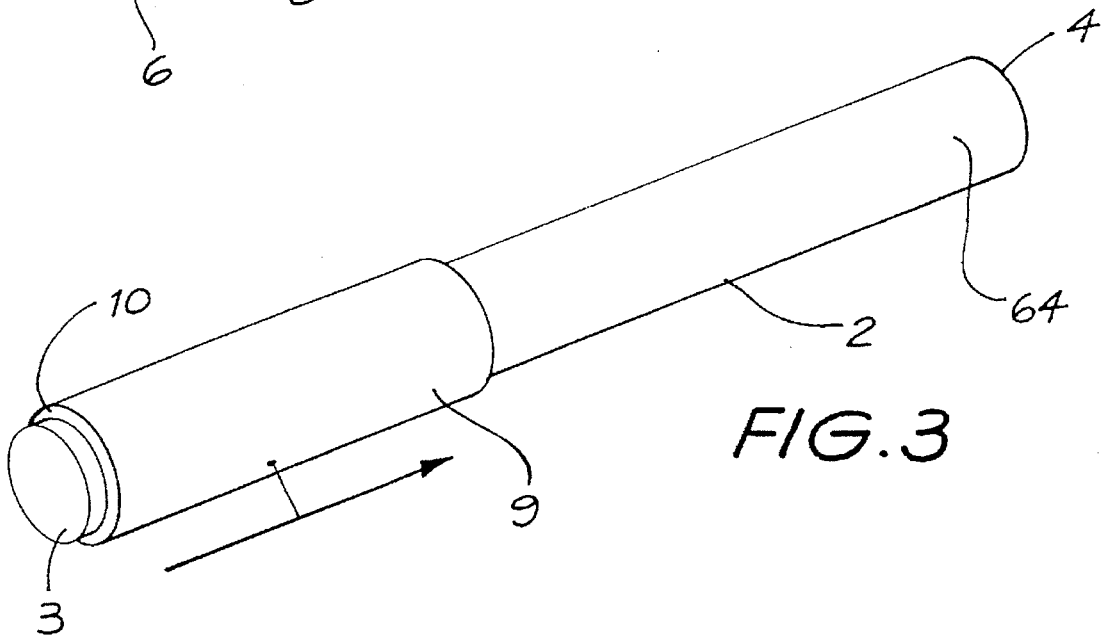
FIG. 3 illustrates the flavour infuser shown in FIG. 1 with the sleeve in its sealing position.

When the desired amount of extraction has occurred the infuser is removed from the cup and drained for a short period. The sleeve (9) as shown in FIG. 3 is slid down the housing (2) to seal the perforations (8) of the perforated wall portion (5), to lessen or prevent dripping of liquid from the interior of the cylindrical housing (2). The dimensions of the sleeve (9) and the cylindrical housing (2) could be such as to provide a tight seal therebetween, or the cylindrical housing (2) at end (3) could have a tapered plug shape to seal against the end (10) of the sleeve (9). A stop (30) as shown in FIG. 7 could be formed with the closed end (3) or integrally with the perforated wall portion (5) is shown in FIG. 8 to stop the sleeve (9) from moving over the closed end (3) of the housing (2).

Hence the infuser can be readily used without need for the user to touch the perforated wall portion (5), and as such is more hygienic than existing products.

The perforated wall portion (5) could be sealed intermediate its ends by a seal (11) to form a chamber as shown in FIG. 2, or alternately the housing (2) is hollow for all the length between ends (3) and (4).

Further the housing (2) could be transparent so that the contents can be readily inspected by potential users. Also the perforations (8) could be of any suitable shape or size. The cylindrical housing (2) and sleeve (9) could be made from any suitable material, such as plastics or paper.

A further embodiment is shown in FIGS. 4*a* and 4*b*, wherein the sleeve (9) has a spoon (12) integral formed therewith. Preferably the tip (29) of the spoon (12) is turned under to reinforce the spoon (12), as shown in FIG. 5.

Yet a further embodiment is shown in FIG. 6 wherein the spoon (12) is integral with the sleeve (9) but is positioned facing the closed end (4) of the housing (2).

To protect the spoon (13) during transportation the spoon (13) is integrally formed with the cylindrical housing (2) as shown in FIGS. 9*a*, 9*b* and 9*c*, wherein the sleeve (9) is slid over both the perforated wall portion (5) and the spoon (13) which folds back radially onto itself as shown in FIG. 9*b*, when sheathed by the sleeve (9).

A further variation of the embodiment shown in FIGS. 9*a*, 9*b* and 9*c* is shown in FIG. 10 wherein the spoon (13) is mounted integral on the housing (2) at the end (4) remote from the perforated wall portion (5).

Rather than have the housing as cylindrical the housing could be of any desired cross section such as that shown in FIG. 11, wherein the housing (14) is crescent in cross section or has a concave upper surface, such that the housing (14) itself at the end (15) or at the perforated end (16) with or without the sleeve (9), can be used as a spoon.

Other embodiments of the infusers of the present invention are shown in FIGS. 12*a*, 12*b* and 12*c* and 13*a* and 13*b*, wherein a compressive force is used to squeeze out liquid from the particulate material. In FIGS. 12*a*, 12*b*, and 12*c*, rather than have perforations, the housing (18) has longitudinal slits (19). A particulate material cartridge (25) could be retained in the flexible holding portion (20) by being inserted during manufacture through one of the slits (19) or by folding the cartridge (25) and pushing it through the open end (21) of the housing (18), where it could hold within the flexible holding portion (20) by locking fingers (31) which face inwardly of the flexible holding portion (20).

The infuser (1) is again used in the same manner as those described previously, and on completion of the extraction the sleeve (9) as shown in FIG. 12*b* is forced over the flexible holding portion (20) squeezing liquid from the particulate material cartridge (25) and sealing the slits (19) as shown in FIG. 12*c*.

The infuser (1) in FIGS. 13*a* and 13*b*, comprises a flexible walled perforated portion (22), with the sleeve (23) being of a rigid material having a taper or a necking (24), whereby when the sleeve (23) is pushed towards the closed end (3) of the infuser (1) as shown in FIG. 13*b* the particulate material held in the infuser (1) is compressed, squeezing liquid therefrom. In both of these embodiments of FIGS. 12 and 13, the sleeves (9) and (23) again seal against the closed ends (3).

Figure 14A:
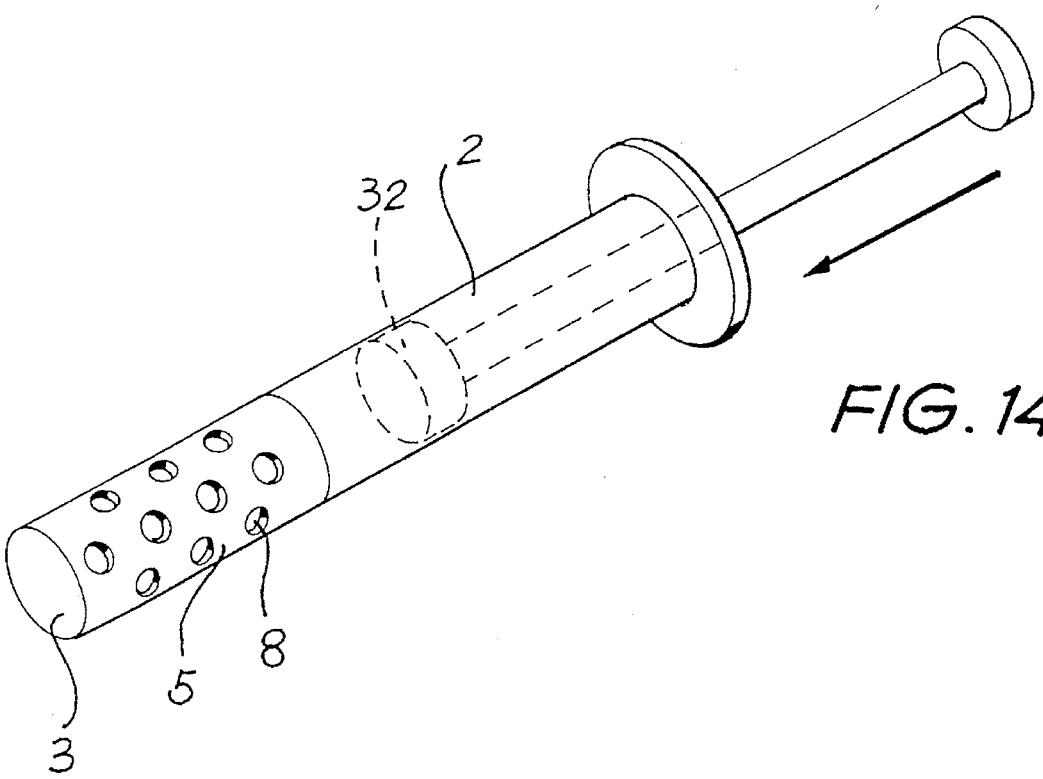
Figure 14B:
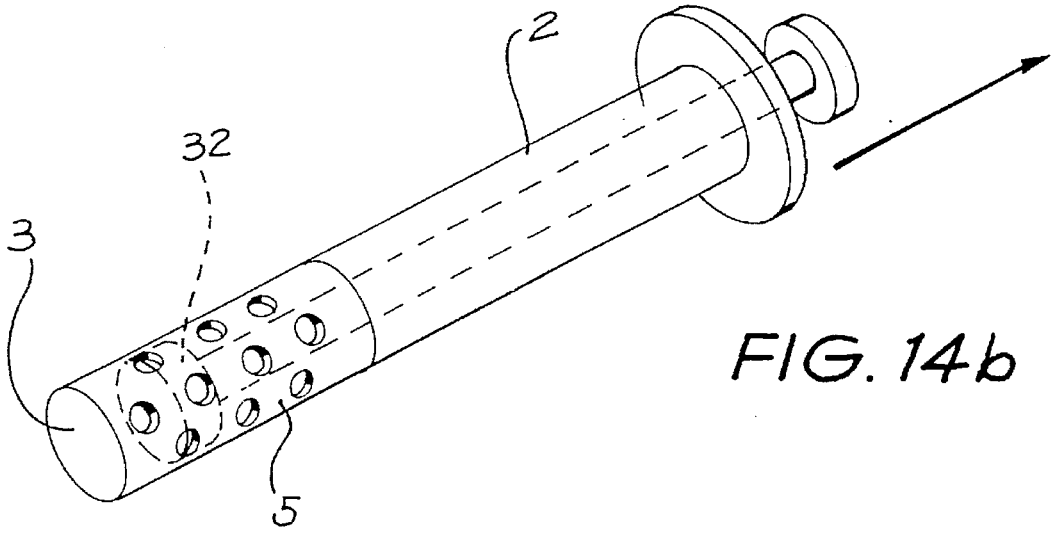

A further squeezing method is shown in FIGS. 14*a* and 14*b* which utilizes a piston (32) which is forced down the hollow cylindrical housing (2), to compress the particulate material. In this embodiment the sleeve has been omitted for clarity.

Figure 15A:
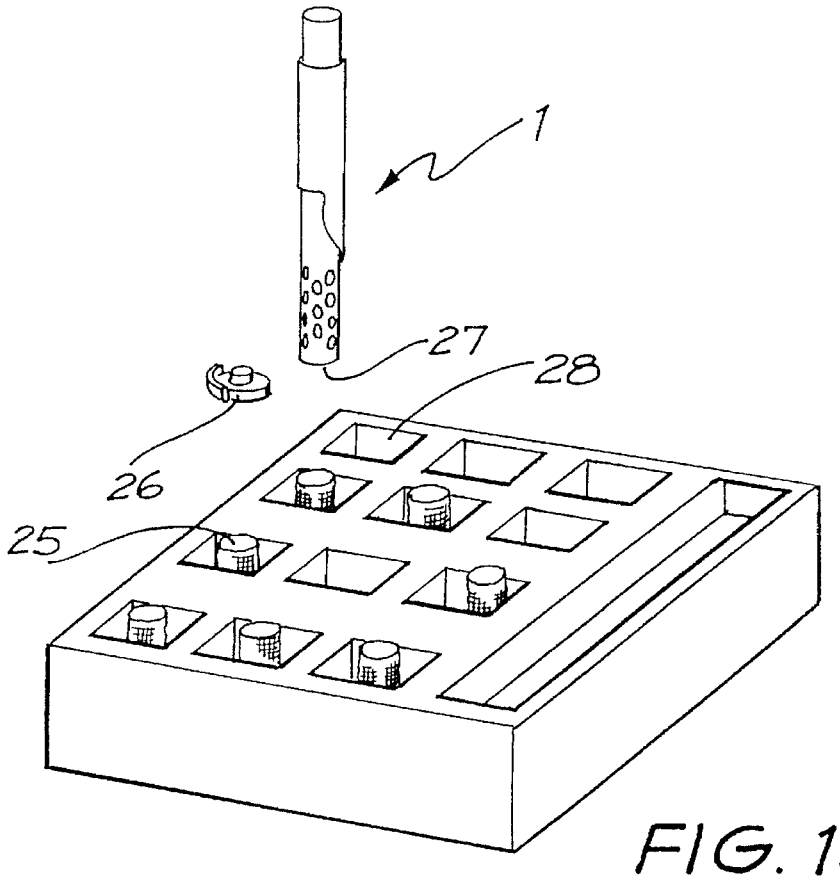
Figure 17:
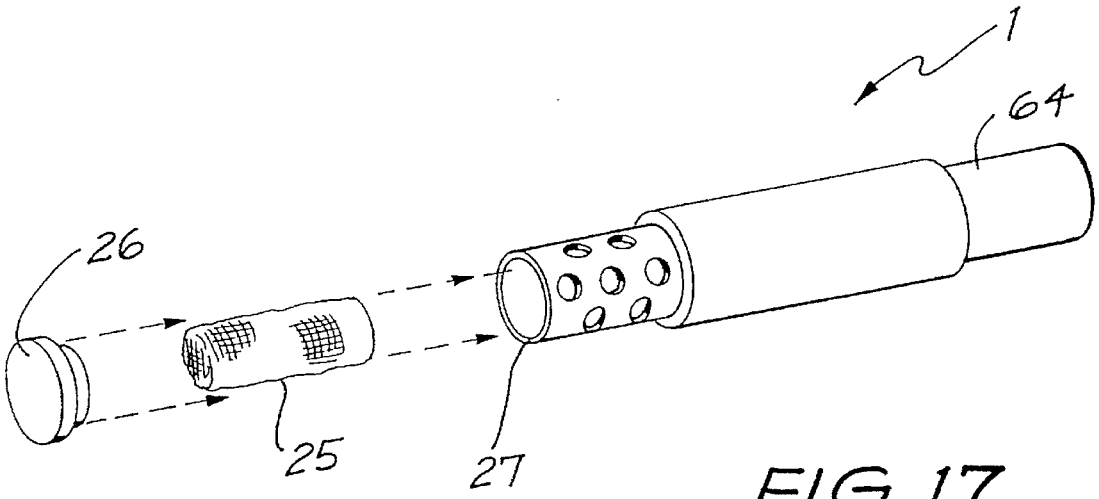

A re-usable infuser is shown in FIGS. 15*a* and 17 wherein a cap (26) is removable from the free end (27) of the infuser (1), and the spent particulate material cartridge (25) is disposed of. The cartridges (25) are held in separate compartments (28) and the infuser (1) is pushed over the cartridge (25) to remove it from its compartment (28) and the cap (26) closed over the free end (27) sealing the cartridge (25) in the infuser (1). The infuser (1) is then operated in its before described manner.

Figure 15B:
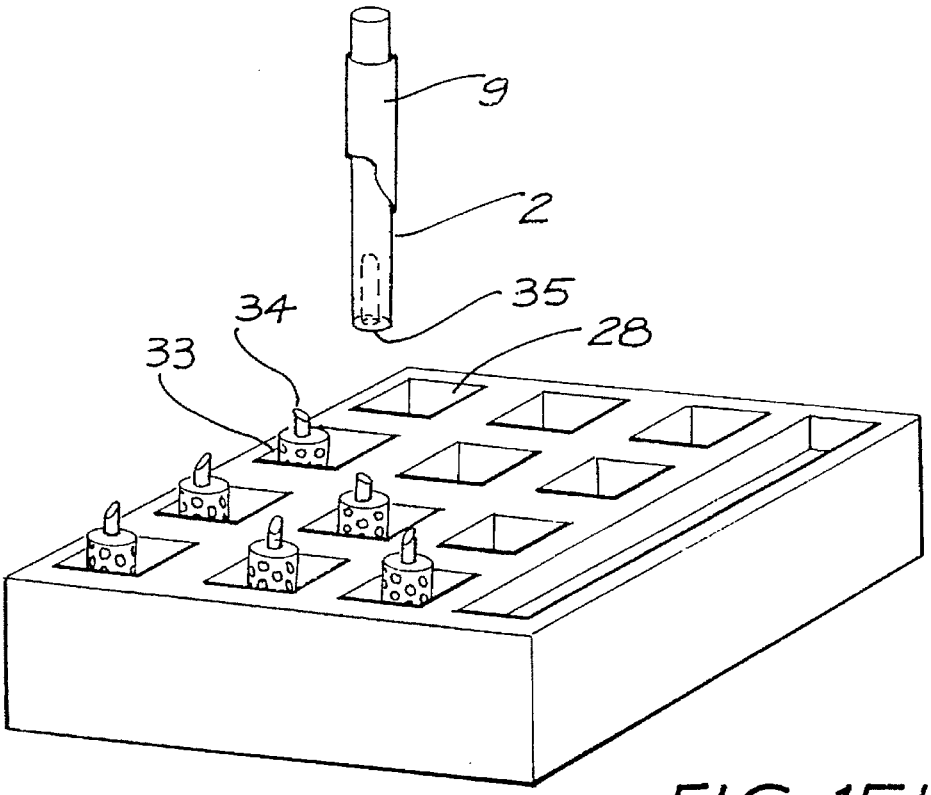
Figure 16:
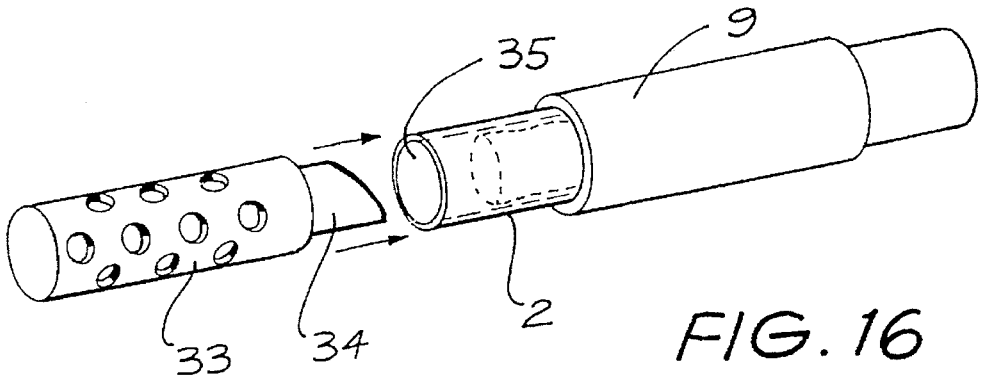

A further reuseable infuser (1) is shown in FIGS. 15*b* and 16 wherein a removeable perforated modular (33) is used which has engaging means (34) which releasably lock into a recess (35) in the housing (2).

Whilst the infuser would predominantly be used for making tea, other substances such as coffee, soup, flavouring, herbed teas, or flavouring for milk or cold drinks, or food additives, chemicals or pharmaceuticals, could also be used.

Figure 18:
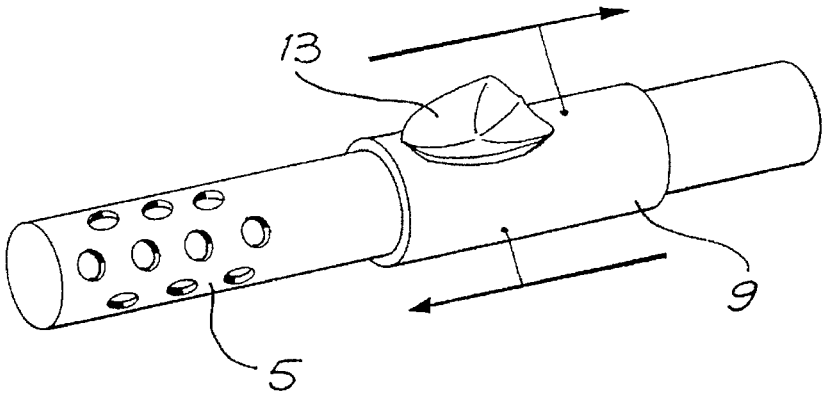

Further rather than have the spoon (13) at the "extraction end" the spoon could be located at the other end or, on top of the sleeve (9) as shown in FIG. 18.

The present invention therefore provides an infuser which is relatively "drip free" to use or dispose of, and that with the sleeve over the perforations provides a good seal to keep the contents fresh.

The infusers could be made from any suitable material such as plastics, or paper products, or plastic coated or impregnated material.

Figure 19A:
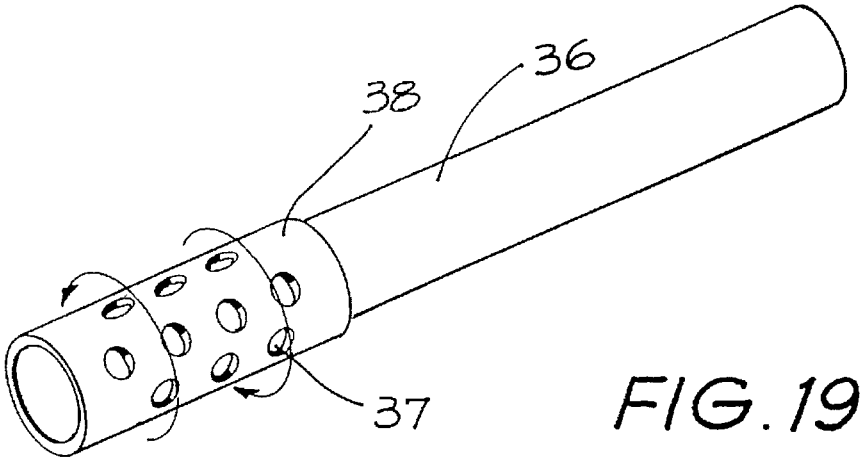
Figure 19B:
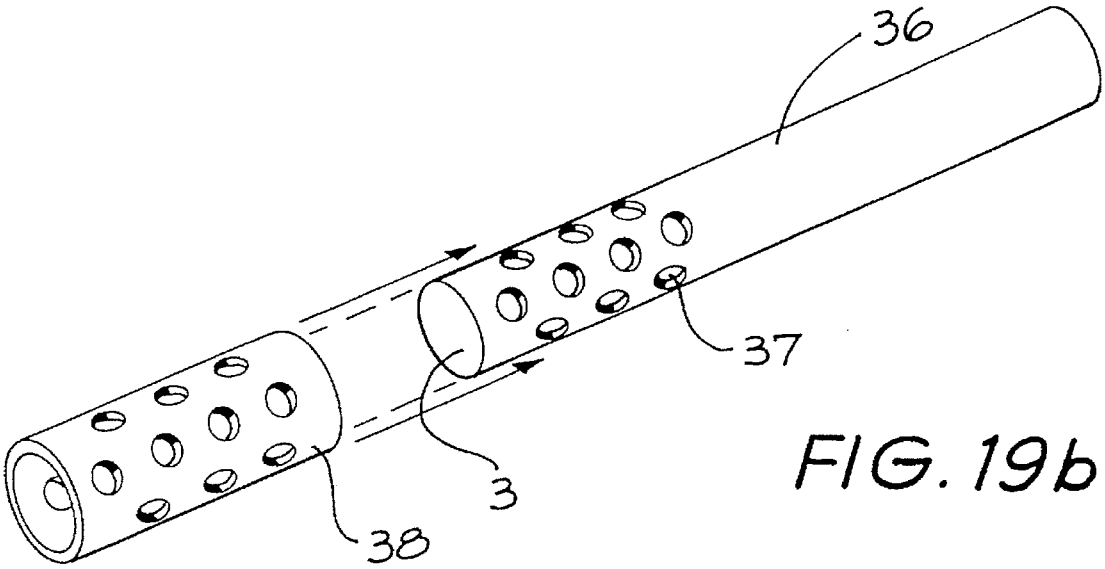
Figure 20A:
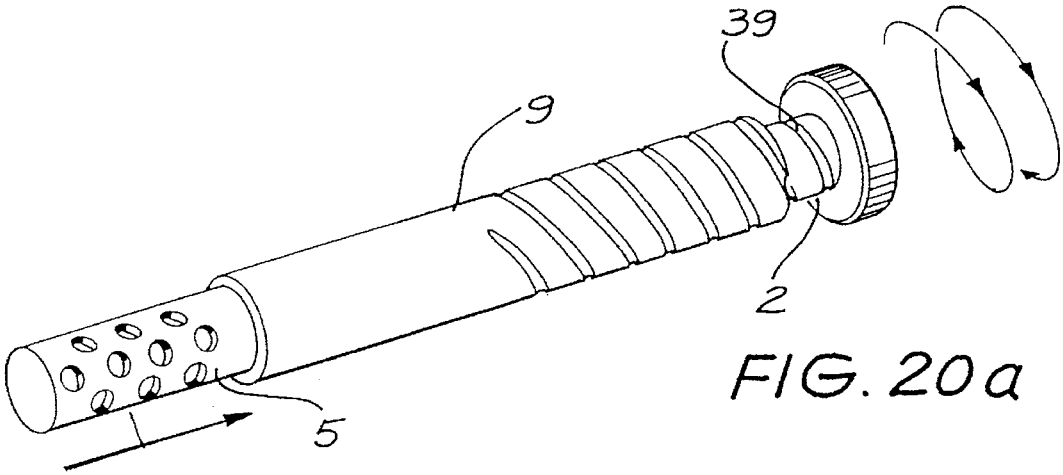
Figure 20B:
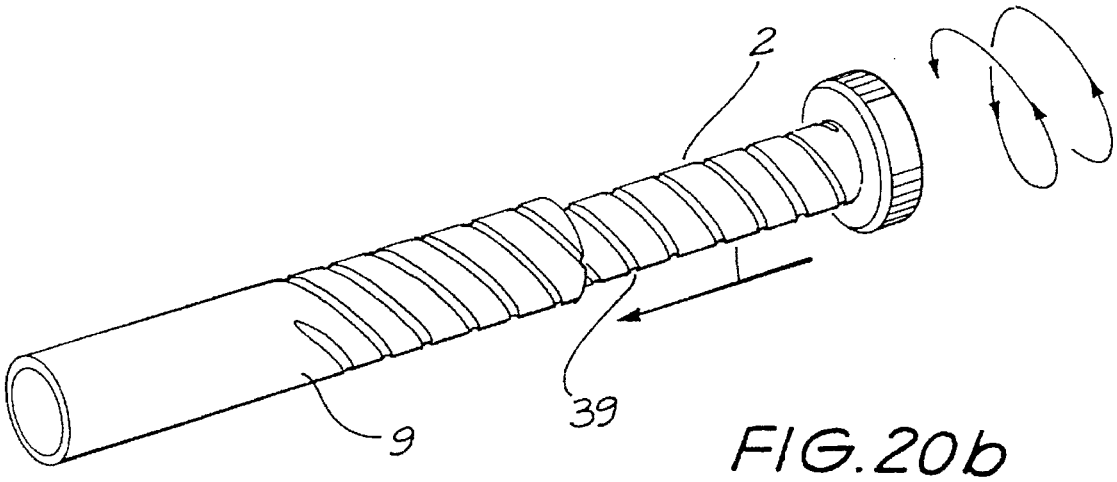

Rather than the sleeve sliding along the housing of the infuser, the housing (36) as shown in FIGS. 19*a* and 19*b*, could have perforations (37) of a similar pattern to that of the sleeve (38) and the sleeve (38) is rotated around the housing (36) to match up the perforations (37) or to close them. In another form, shown in FIGS. 20*a* and 20*b*, the sleeve (9) or the cylindrical housing (2) could climb on a helical pathway (39) along the other component, in a similar manner to the operation of a lipstick.

The infuser (1) of FIGS. 21 and 22, rather than have a perforated chamber lined with a porous material as shown in FIGS. 1 and 2, has a porous end (40) with the tea leaf or the like located within the infuser (1), allowing infusion through the pores. A sleeve (9) can be slid along the infuser (1) to cover or expose the porous material (40), as shown in FIGS. 21 & 22. The sleeve (9) could be C shaped in cross section to cover a corresponding shaped porous area.

As shown in FIGS. 23 & 24, the perforated wall portion (41) can be of any suitable shape and have perforations (8) located only on one side of the infusion charge holding chamber (42), with a complementary shaped sealing portion (43) able to slide over and close or expose the perforations (8). Any suitable means such as a retaining band (44) can be used to hold the two parts in engagement.

Rather than have perforations all the way around the infuser, perforations (8) could be located only on one side of the infuser (1). As shown in FIGS. 25, 26 & 27, the sealing portion or sleeve (43) is hingedly attached to the rear of the infusion charge holding chamber (42), and is pivoted from its open position as shown in FIG. 25 to its closed position as shown in FIG. 27 where it snaps over the perforated wall portion (41), closing the perforations (8).

The infuser can therefore be packaged in a smaller length than its "in use" length.

The infuser as shown in FIGS. 28 & 29 can have a non uniform cross-section infusion holding chamber (45). The infuser is used in the beforementioned manner, with the sleeve (46) being of a complementary shape to seal the perforations (8), as shown in FIG. 29.

The embodiment shown in FIGS. 30 and 31 have the end (47) of the infuser (1) heat sealed for ease of production. The sleeve (48) is flexible such that it can expose the perforations (8) as shown in FIG. 30 or seal them as shown in FIG. 31 as it moves along the infuser (1).

FIGS. 32 & 33 show an infuser with a annular body (49) with the perforations (8) located on the inner surface (50) of the annular infusion holding chamber (51) with the "tea leaves" located therein. A central sealing tube or rod (52) slides within the hollow to seal or expose the perforations (8).

In the two embodiments shown in FIGS. 34, 35 & 36 and FIG. 37, the infuser has been made telescopically collapsible to decrease the volume of storage.

As shown in FIG. 34, 35 & 36 the infusion charge holding chamber (51) is telescopically connected to the extension rod (53). Therefore as shown in FIG. 36 when the sleeve (9) is covering the perforations (8), the extension rod (53) can be withdrawn into the solids containing chamber (51).

FIG. 37 illustrates schematically one means of forming a collapsible infuser. The sleeve (54) encloses the perforated chamber (55) to seal the perforations (8). The sleeve (54) has an annular shoulder (56) against which the end (57) of the perforated chamber (55) abuts. A hollow extension tube (58) slides through the central opening of the annular shoulder (56) into the perforated chamber (55) in sealing engagement with the end (57) of the chamber (55).

The sleeve (54) may or may not have the spoon (59). In use the extension tube (58) is withdrawn out of the chamber (55) until the end (57) of the chamber (55) locks onto the groove (60) of the extension tube (58). The sleeve (54) can then be slid towards the free end of the extension tube (58), exposing the perforations (8). The "tea leaves" can be loose in the chamber (55) with appropriate porous material coveting the perforations or the "tea leaves" could be enclosed in a porous cartridge (61). After use the infuser can be moved to its "collapsed" condition.

Rather than use a sleeve to seal the perforations, the infuser body itself could be collapsible, as shown in FIGS. 38 and 39, and FIGS. 40 and 41.

The infuser body (62) could be concertina shaped as shown in FIGS. 38 & 39, wherein the body (62) is expanded as shown in FIG. 38 so as to be used to stir the liquid in order to infuse the liquid, and then compressed to seal the perforations (8) as shown in FIG. 39.

A similar concept is applied in the embodiments shown in FIGS. 40 and 41, except that the collapsible infuser body (63) is twisted to close or expose the perforations (8).

A modification, as shown in FIGS. 42, 43 and 44, of the embodiment shown in FIGS. 25, 26 and 27 wherein the infuser (1) is elongated to provide a gripping portion (64) remote from the perforated wall portion (42).

As shown in FIGS. 45, 46 and 47, the outer layer (65) of the infuser (1) could have lines of weakness (67) and be attached to the sleeve (66). Upon sliding the sleeve towards the end (4), the outer layer (65) tears along the lines of weakness (67) exposing the perforations (8). Instead of the perforations there could be slits or the like. Further, instead of a single finger of outer layer (65), there could be a plurality of fingers connected to the sleeve (66) which tear along lines of weakness forming slits as the perforations.

Once infusion has taken place, the sleeve, which is of suitable dimension, is slid down to the end (3) coveting the perforations, or slits, to resist the infuser from leaking.

With all of the embodiments shown the sleeve could have a spoon formed therewith located at either end or even attached directly to the body of the infuser.

As a disposable unit the infuser body, spoon and/or sleeve could be made from paper or a light cardboard.

It should be obvious to people skilled in the art that modifications and alterations can be made to the infusers shown above without departing from the spirit or scope of the present invention.

I claim:

1. An infuser, adapted to hold solids, from which to infuse a substance into a liquid in which the infuser is immersed, comprising:

an elongated member having an outer surface with a first end portion, an intermediate portion and a second end portion;

an infuser charge holding chamber, located at the first end portion of the elongated member, and having perforations or porous material thereon, communicating between the infusion charge holding chamber and the said outer surface:

a gripping portion located at said second end portion; and a sleeve, of smaller length than that of the elongated member, adapted to move along or over said elongated member between said first end portion and said intermediate portion of said elongated member, such that in a first position, with the sleeve on said intermediate portion, the perforations or porous material of said first end portion are exposed, whereby, in use with the infuser charge in said chamber, when said infuser charge holding chamber is immersed in the desirable liquid, infuses a substance into the liquid, while in a second position the sleeve covers the perforations or the porous material of said first end portion to resist leakage of liquid from said chamber, said sleeve and said elongated member being so dimensioned that, in use, the elongated member is held, by a user, at the gripping portion and said sleeve is moved along or over the said elongated member between the first end portion and the intermediate portion, without covering the gripping portion, so that there is no need for the user to touch the perforations or porous material of the infusion charge holding chamber.

2. An infuser according to claim 1 wherein said elongated member is cylindrical and the sleeve is a hollow cylinder of sufficient length to cover the perforations or the porous material.

3. An infuser according to claim 2 wherein the said other end of the elongated member has a stop to prevent the sleeve from over running the said other end.

4. An infuser according to claim 1 wherein said sleeve has a spoon shaped projection.

5. An infuser according to claim 1, wherein said infuser charge holding chamber is C-shaped in cross section with the perforations or the porous material located on the inner surface of the C, and the sleeve has a complementary shaped sealing portion, with retaining means holding the elongated member and the sleeve in sliding engagement.

6. An infuser according to claim 1 wherein the elongated member is curved in profile.

7. An infuser according to claim 1 wherein the perforations or porous material are located on a limited area around the outer surface of the elongated member, and the sleeve is pivotally connected to the elongated member to move from its first position to its second position where it snaps over the perforations or porous material.

8. An infuser according to claim 1 wherein the outer surface of the elongated member, surrounding the infuser charge holding chamber is nonuniform in cross section, and the sleeve is complementary in shape.

9. An infuser according to claim 8 wherein the outer surface of the elongated member surrounding the infuser charge holding chamber is conical.

10. An infuser according to claim 1 wherein the sleeve travels along a helical track around the elongated member.

11. An infuser according to claim 1 further including a plunger telescopically moveable within the elongated member.

12. An infuser according to claim 1 wherein the perforations are longitudinal slits, and the infuser charge is contained in a porous cartridge, contained in the infuser charge holding chamber.

13. An infuser according to claim 1 wherein the elongated member is flexible and the sleeve is substantially rigid and has a necking whereby, in use, the necking squeezes the infuser charge expelling liquid therefrom.

14. An infuser according to one of claim 1 wherein the infuser charge or the charge holding chamber and its infuser charge is replaceable when the infuser charge is spent.

15. An infuser, adapted to hold solids, from which to infuse a substance into a liquid in which the infuser is immersed, comprising:

an elongated member having an outer surface with a first end portion, an intermediate portion and a second end portion;

an infuser charge holding chamber, located at the first end portion of the elongated member, and having perforations thereon, communicating between the infusion charge holding chamber and the said outer surface;

a gripping portion located at said second end portion;

porous material, adapted to allow the flow of liquid therethrough, lining said infuser charge holding chamber and a sleeve, of smaller length than that of the elongated member, adapted to move along or over said elongated member between said first end portion and said intermediate portion, such that in a first position, with the sleeve on said intermediate portion, the perforations are exposed, whereby, in use with the infuser charge in said chamber, when said infuser charge holding chamber is immersed in the desirable liquid, infuses a substance into the liquid, while in a second position the sleeve covers the perforations of said first end portion, to resist leakage of liquid from said chamber, said sleeve and said elongated member being so dimensioned that, in use, the elongated member is held, by a user, at the gripping portion, and said sleeve is moved along or over the said elongated member between the first end portion and the intermediate portion without covering the gripping portion, so that there is no need for the user to touch the perforations of the infusion charge holding chamber.

* * * * *